US006142456A

United States Patent [19]

Machiya et al.

[11] Patent Number: 6,142,456

[45] Date of Patent: Nov. 7, 2000

[54] METHOD AND APPARATUS FOR DISSOLVING AND MIXING GAS AND LIQUID

[75] Inventors: Katsuyuki Machiya; Masakazu Kashiwa; Masaaki Nakayama, all of Toyama-ken, Japan

[73] Assignee: IDEC Izumi Corporation, Osaka, Japan

[21] Appl. No.: 09/091,373

[22] PCT Filed: Apr. 23, 1997

[86] PCT No.: PCT/JP97/01469

§ 371 Date: Jun. 17, 1998

§ 102(e) Date: Jun. 17, 1998

[87] PCT Pub. No.: WO98/18543

PCT Pub. Date: May 7, 1998

[30] Foreign Application Priority Data

Oct. 25, 1996 [JP] Japan ..... 8-301186

[51] Int. Cl.[7] ..... B01F 3/04

[52] U.S. Cl. ..... 261/76; 261/115; 261/116

[58] Field of Search ..... 261/76, 77, 115, 261/116, 123

[56] References Cited

U.S. PATENT DOCUMENTS 904,301 11/1908 Black et al. ..... 261/115
2,271,896 2/1942 Lewis ..... 261/115
3,367,402 2/1968 Cross, Jr. et al. ..... 261/116
4,164,541 8/1979 Platz et al. ..... 261/76
5,514,267 5/1996 Machiya .

FOREIGN PATENT DOCUMENTS 4-161235 10/1990 Japan .
6-269651 12/1993 Japan .

*Primary Examiner*—C. Scott Bushey
*Attorney, Agent, or Firm*—Baker & Daniels

[57] ABSTRACT

A method and apparatus for dissolving and mixing a gas and a liquid wherein an injection portion for injecting a liquid at a flow rate in the range from approximately 5 m/s to approximately 15 m/s in a horizontal direction is provided at an upper part of a mixing container filled with a gas; a restrictor for maintaining a pressurized state in the mixing container is provided downstream of the mixing container; and a liquid is injected into the mixing container from the injection portion to cause a reaction or dissolution between the gas in the mixing container and the injected liquid in the pressurized state and to cause a liquid including the gas dissolved therein to flow from a lower part of the mixing container. The gas is supplied upstream of the injection.

10 Claims, 15 Drawing Sheets

METHOD AND APPARATUS FOR DISSOLVING AND MIXING GAS AND LIQUID

TECHNICAL FIELD

The present invention relates to a method and apparatus for dissolving and mixing a gas and a liquid wherein a reaction is caused between a gas and a liquid under a pressure or wherein pressurized water with a gas dissolved therein in an oversaturated state or the like is supplied.

BACKGROUND ART

Conventional apparatuses for dissolving and mixing a gas and a liquid include those having a suction device which is a fluid channel having a restriction portion to absorb a gas into a liquid in order to form a mixed flow of the gas and liquid, as disclosed in Japanese unexamined patent publication No. H6-285345 of the applicant. Such a suction device includes an expanded portion formed by a pipe line that is gradually expanded downstream of the restriction portion and includes a gas intake channel for introducing a gas provided thereon slightly downstream of the restriction portion. A liquid is delivered by a pressure to the suction device. The flow of the liquid delivered by a pressure forms a negative pressure at the restriction portion to suck the gas, thereby forming a mixed flow of the gas and liquid.

In the case of the apparatus for mixing a gas and a liquid disclosed in the above-mentioned patent publication, the pressure to deliver a liquid becomes high, because it operated by supplying a gas into the liquid by utilizing the energy of the liquid delivered by a pressure, i.e., a negative pressure produced by the rate of the flow. This has resulted in a problem in that the pump as a means for pressure delivery is expensive and there is a poor choice for the pump because it consumes high motive power and must provide a high pumping pressure.

The present invention has been conceived taking the above-described problem with the prior art, and it is an object of the invention to provide a method and an apparatus for dissolving and mixing a gas and a liquid which allow a gas and a liquid to react and to be dissolved efficiently with less energy.

DISCLOSURE OF THE INVENTION

The present invention is a method of dissolving and mixing a gas and a liquid comprising the steps of providing an injection portion for injecting a liquid at a flow rate in the range from approximately 5 m/s to approximately 15 m/s in a horizontal direction at an upper part of a mixing container filled with a gas, providing a restrictor, which is a restricted channel, for maintaining a pressurized state in the mixing container downstream of the mixing container, injecting a liquid into the mixing container from the injection portion to cause a reaction or dissolution between the gas in the mixing container and the injected liquid in the pressurized state and to cause a liquid including the gas dissolved therein to flow from a lower part of the mixing container, stopping the supply of the liquid into the mixing container when the gas in the mixing container is reduced as a result of the dissolution of the gas into the liquid therein, supplying the gas into the mixing container, and alternately performing the injection of the liquid and the supply of the gas into the mixing container.

Further, the present invention is a method of dissolving and mixing a gas and a liquid comprising the steps of providing an injection portion having a restriction portion which is a partial restriction of a fluid channel and having a suction device formed with a gas intake port for introducing a gas from the outside provided slightly downstream thereof, mounting the injection portion to an upper part of a mixing container filled with a gas, providing a restrictor, which is a restricted fluid channel, for maintaining a pressurized state in the mixing container downstream of the mixing container, injecting a liquid into the mixing container from the injection portion at a flow rate in the range from approximately 5 m/s to approximately 15 m/s to cause a reaction or dissolution between the gas in the mixing contained and the injected liquid and to cause a liquid including the gas dissolved therein to flow from a lower part of the mixing container, injecting the liquid into the mixing container with the gas sucked through the suction device of the injection portion by reducing the pressure inside the mixing container when the gas in the mixing container is reduced as a result of the dissolution of the gas into the liquid therein, performing only the injection of the liquid with the reduction of the pressure in the mixing container stopped to stop the suction from the suction device when the gas in the mixing container is increased, and alternately performing the operation of only injecting the liquid and the operation of injecting the liquid accompanied by suction by the injection portion.

Moreover, the present invention is a method of dissolving and mixing a gas and a liquid comprising the steps of providing an injection portion for injecting a liquid at a flow rate in the range from approximately 5 m/s to approximately 15 m/s in a horizontal direction at an upper part of a mixing container filled with a gas, providing a restrictor, which is a restricted channel, for maintaining a pressurized state in the mixing container downstream of the mixing container, injecting a liquid into the mixing container from the injection portion to cause a reaction or dissolution between the gas in the mixing container and the injected liquid in the pressurized state and to cause a liquid including the gas dissolved therein to flow from a lower part of the mixing container, and injecting the gas into a liquid supplying pipe line upstream of the injection portion at a pressure slightly higher than the supply pressure of the liquid (less than 110% of the supply pressure of the liquid) when the gas in the mixing container is reduced as a result of the dissolution of the gas into the liquid therein. According to the method of dissolving and mixing a gas and a liquid, when the gas in the mixing container is reduced as a result of the dissolution of the gas into the liquid therein, the gas is injected into the mixing container at a pressure slightly higher than the pressure of the gas inside the mixing container (less than 110% of the pressure of the gas inside the mixing container).

Further, the liquid level in the mixing container is adjusted to the height of an exit port of the injection portion.

Further, the present invention is an apparatus for dissolving and mixing a gas and a liquid comprising a mixing container filled with a gas, an injection portion such as a nozzle provided at an upper part of the mixing container for injecting a liquid into the mixing container in a hermetic state at a flow rate in the range from approximately 5 m/s to approximately 15 m/s in a horizontal direction, an exit port for the liquid provided at a lower part of the mixing container, and a restrictor, which is a restricted channel, provided downstream of the exit port including a pressure adjusting valve and other restrictors for maintaining a pressurized state in the mixing container, wherein a liquid is injected into the mixing container from the injection portion to cause a reaction or dissolution between the gas in the mixing container and the injected liquid and to cause a liquid including the gas dissolved therein to flow through the exit port and the restrictor. Further, there is provided a transfer valve between the upper part of the mixing container and the upstream side of the injection portion, a gas tank provided upstream of the transfer valve, and a gas injection means provided upstream of the gas tank comprising a gas supply source such as a compressor and a gas cylinder.

Moreover, the present invention is an apparatus for dissolving and mixing a gas and a liquid comprising a restriction portion in the form of a venturi tube or the like which is a restricted part of a fluid channel, a cylindrical channel formed slightly downstream thereof having an inner diameter slightly larger than the restriction portion, an expanded portion which is a gradually expanded pipe line provided downstream of the cylindrical channel, an injection portion connected to the cylindrical channel having a gas intake port for introducing a gas from the outside, which is mounted on an upper part of a mixing container filled with a gas and opened into the mixing container, an exit port for the liquid provided at a lower part of the mixing container, a restrictor provided on one of pipe lines branched downstream of the exit port, which is a channel restricted for maintaining a pressurized state in the mixing container, and an on-off valve provided on the other pipe line, wherein a liquid is injected from the injection portion into the mixing container in a hermetic state to cause a reaction of dissolution between the gas in the mixing container and the injected liquid and to supply a liquid including the gas dissolved therein through the exit port and the restrictor.

Furthermore, a plurality of the mixing container having an injection are disposed in parallel with each other; each of the injection portions is connected to a liquid supply source through a pipe line; and a pipe line and a restrictor are provided at the exit port of each of the mixing container.

Further, the present invention is an apparatus for dissolving and mixing a gas and a liquid comprising a mixing container filled with a gas, an injection portion such as a nozzle provided at an upper part of the mixing container for injecting a liquid into the mixing container in a hermetic state at a flow rate in the range from approximately 5 m/s to approximately 15 m/s in a horizontal direction, a liquid supply device such as a pump for supplying the liquid, a gas supply device for supplying a gas into a fluid channel at a pressure slightly higher than the supply pressure of the liquid at the fluid channel upstream of the injection portion (less than 110% of the supply pressure of the liquid), an exit port for the liquid provided at a lower part of the mixing container, and a restrictor, which is a restricted channel, provided downstream of the exit port including a pressure adjusting valve and other restrictors for maintaining a pressurized state in the mixing container, wherein a liquid is injected into the mixing container from the injection portion to cause a reaction or dissolution between the gas in the mixing container and the injected liquid and to supply a liquid including the gas dissolved therein to flow through the exit port and the restrictor. Further, the gas supply device supplies the gas into the mixing container at a pressure slightly higher than the pressure of the gas inside the mixing container (less than 110% of the pressure of the gas in the mixing container).

Further, there is provided an apparatus for dissolving and mixing a gas and a liquid wherein the gas supply device includes a gas tank provided downstream of a compressor or the like and a restrictor such as a valve or a fixed restrictor provided downstream thereof and wherein a gas is supplied into the liquid supply pipe line and the mixing container at a pressure slightly higher than the supply pressure of the liquid for each predetermined period or depending on predetermined conditions of the gas.

Further, the apparatus for dissolving and mixing a gas and a liquid according to the present invention is an apparatus for dissolving and mixing a gas and a liquid wherein another mixing container similar to that described above is connected in series downstream of the exit port through a pipe line; the pipe line is connected to an upper part of the mixing container; and the restrictor is connected to an exit port of the other mixing container.

Further, a diaphragm is provided which separates the injected liquid from the liquid therebelow over a predetermined distance in the direction in which the liquid is injected by the injection portion. The exit port is mounted on wall surfaces other than the wall surface in the mixing container facing the injecting direction of the liquid and wall surfaces in the vicinity thereof. Alternatively, there is provided an apparatus for dissolving and mixing a gas and a liquid wherein a diaphragm is provided below the injection portion in the injecting direction of the liquid and the exit port is provided below the diaphragm and substantially directly under the injection portion. A through holes is formed on the diaphragm toward the injection portion, and the through hole is formed to be relatively larger in a lower part thereof.

Modes for carrying out the method and apparatus for dissolving and mixing a gas and liquid according to the present invention will now be described with reference to the drawings.

FIGS. 1 and 2 show a first embodiment of the present invention. FIG. 1 shows a state at the beginning of delivery of a liquid by a pressure, and FIG. 2 shows a state during a normal operation. In this embodiment, a nozzle 12 which is an injection portion connected to a pipe line 10 for supplying a liquid is connected to an upper part of a mixing container 14 which is hermetically formed. A restrictor 20 is connected to a lower part of the mixing container 14 through a pipe line 18 that extends from an exit port 16, and a pipe line 22 for discharge is connected downstream of the restrictor 20. Although the restrictor is shown as a fixed restrictor in FIG. 1, a variable restrictor such as a valve may be used.

Figure 1:
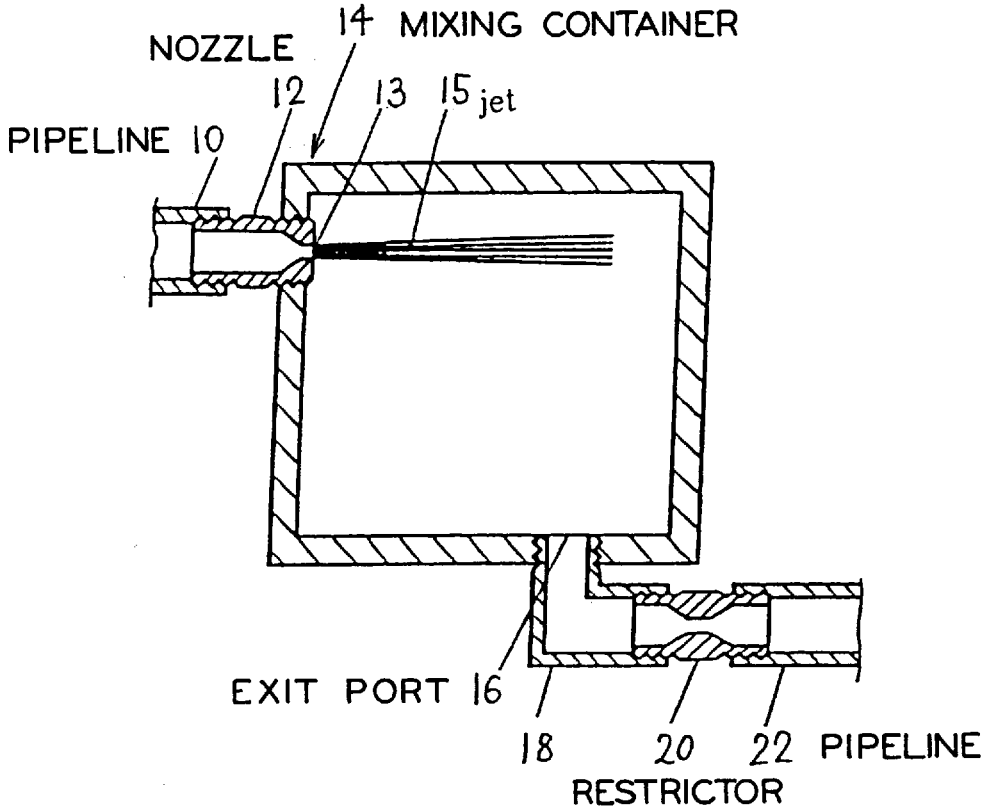
FIG. 1 is a sectional view of an apparatus for dissolving and mixing a gas and a liquid according to a first embodiment of the present invention.
Figure 2:
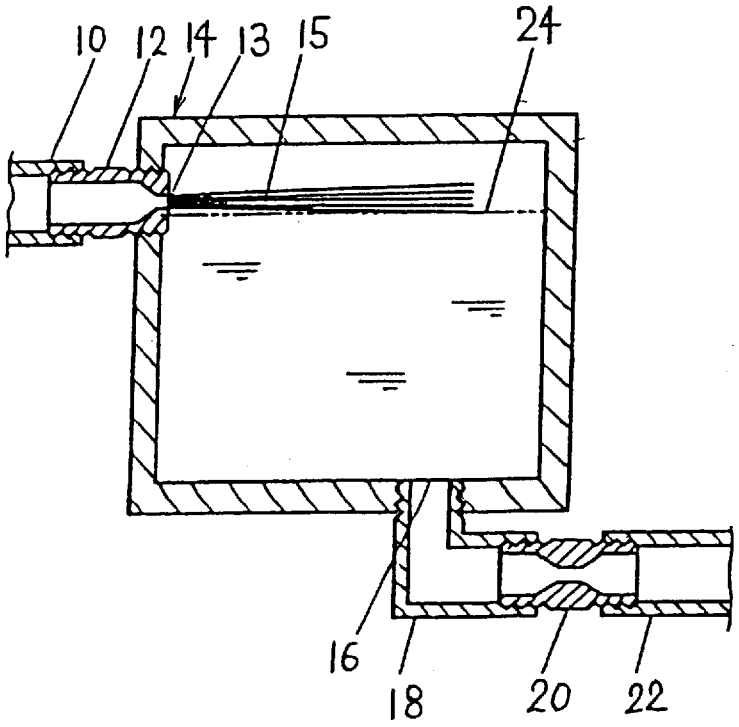
FIG. 2 is a sectional view showing a state of the apparatus for dissolving and mixing a gas and a liquid according to the first embodiment of the present invention in use.

In the apparatus for dissolving and mixing a gas and a liquid in this embodiment, a liquid which dissolves a gas therein flows from the outside to the nozzle 12 through the pipe line 10. The liquid is accelerated by the nozzle 12 and to be injected into the mixing container 14 as a jet 15. The mixing container 14 is filled in advance with a gas to be dissolved in the liquid, and the volume of the gas is compressed by the liquid that flows in to establish a pressurized state in the mixing container 14 gradually. A reaction or dissolution between the gas and liquid takes place in the mixing container 14 in such a pressurized state.

In order to cause the reaction or dissolution between the gas and liquid efficiently, the flow rate of the jet 15 of the accelerated liquid must be at least on the order of 5.0 m/s and is preferably about 10 m/s when energy efficiency is considered. A flow rate beyond 15.0 m/s will not promote the reaction between the gas and liquid and will only result in an increase in the energy required for the pressure pumping of the liquid. The sectional area of an opening 13 at the exit port of the nozzle 12 to achieve such a flow rate is set according to the following relational expression derived from an equation of continuity.

$$S1=Q/U \quad (1)$$

where S1 represents the sectional area of the opening (m2); Q represents the quantity of the liquid flow (m3/s); and U represents the flow rate of the liquid (m/s).

The liquid which has reacted with the gas in the mixing container 14 flows out of the mixing container 14 through the pipe line 18 connected to the exit port 16. Since the exit port 16 is provided at a lower part of the mixing container 14, the gas filled in the container does not flows out but the liquid, and the liquid has a higher flow rate after passing through the pipe line 18 where it is accelerated by the restrictor 20. The mixing container 14 is brought into a pressurized state which is in accordance with the flow rate of the liquid passing through the restrictor 20, and the liquid flows out of the apparatus through the pipe line 22 after passing through the restrictor 20. There is the following relationship between the sectional area of the restrictor 20 and the pressure in the mixing container 14.

$$P1=(Q2/2S22 \quad (2)$$

where (represents the density of the liquid (Kg/m3); P1 represents the pressure (gauge pressure) in the mixing container (Pa); and S2 represents the sectional area of the restrictor (m2).

In this embodiment, a more efficient reaction or dissolution between the gas and liquid can be achieved when a liquid level 24 is close to the position of the opening 13 of the nozzle 12 during the normal operation. The liquid level can be set in such a position if there is the following relationship between the volume of each part of the mixing container 14 and the pressure in the container.

$$P1/P0=V1/V0-1 \quad (3)$$

where P0 represents the pressure in the mixing container before the injection of the liquid (Pa); P1 represents the pressure in the container when sealed (Pa); V0 represents the volume of the mixing container (m3); and V1 represents the volume of the mixing a portion above the nozzle opening of the mixing container (m3).

The apparatus for dissolving and mixing a gas and a liquid according to the present embodiment for carrying the invention can be operated with a relatively low level of energy because it does not involve suction and delivery of a liquid by a pressure and achieves mixing of a gas and a liquid with high efficiency. Further, since the liquid collects at a lower part of the container, the gas is unlikely to flow out from the exit port 16. Thus, the gas is not wasted and is used with high efficiency. Although the liquid in the mixing container 14 is reduced as a result of dissolution of the gas into the liquid, the mixing container may be charged as needed using a gas cylinder, compressor or the like when it is reduced to a certain level, which process is repeated thereafter as needed.

Figure 3:
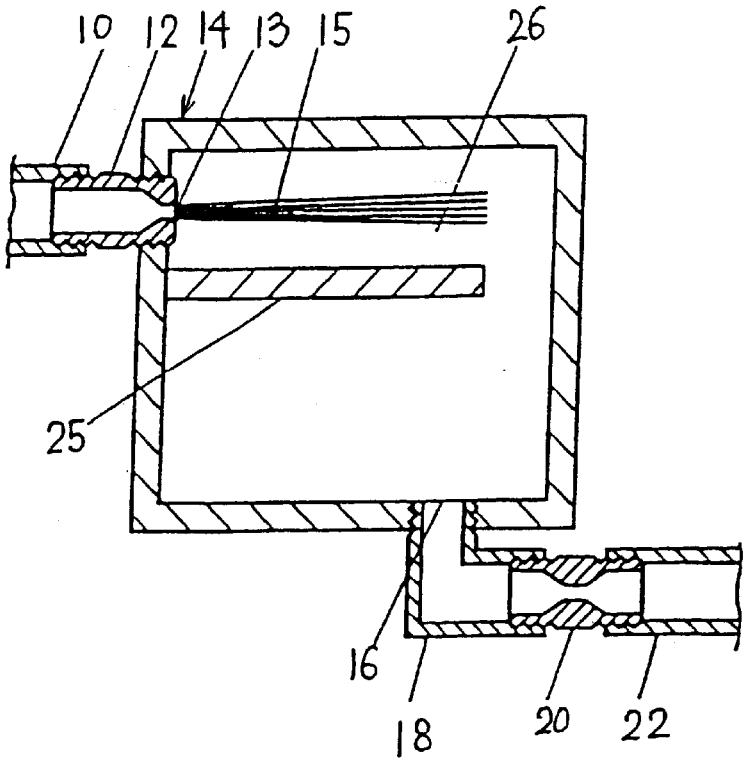
FIG. 3 is a sectional view of an apparatus for dissolving and mixing a gas and a liquid according to a second embodiment of the present invention.

Next, FIG. 3 shows a second embodiment of the present invention. The apparatus for dissolving and mixing a gas and a liquid according to the present embodiment is obtained by providing a duct portion 26 separated by a diaphragm 25 at the region of the apparatus for dissolving and mixing a gas and a liquid according to the first embodiment where a jet 15 from the nozzle 12 flows in. It is similar to the first embodiment with regard to other various conditions and the manner in which it is used.

In the present embodiment, the jet 15 is segregated in a narrow space by a duct portion 26, and vortexes of various sizes are produced in the duct portion 26 to allow a high level of contact between the gas and liquid, thereby causing a highly efficient reaction or dissolution between the gas and liquid within the duct portion 26. The size of the duct portion 26 is preferably set at a size 10 to 20 times larger than the diameter of the jet 15. In the present embodiment, again, the closer the liquid level to the nozzle 12, the higher the level of contact between the gas and liquid.

Figure 4:
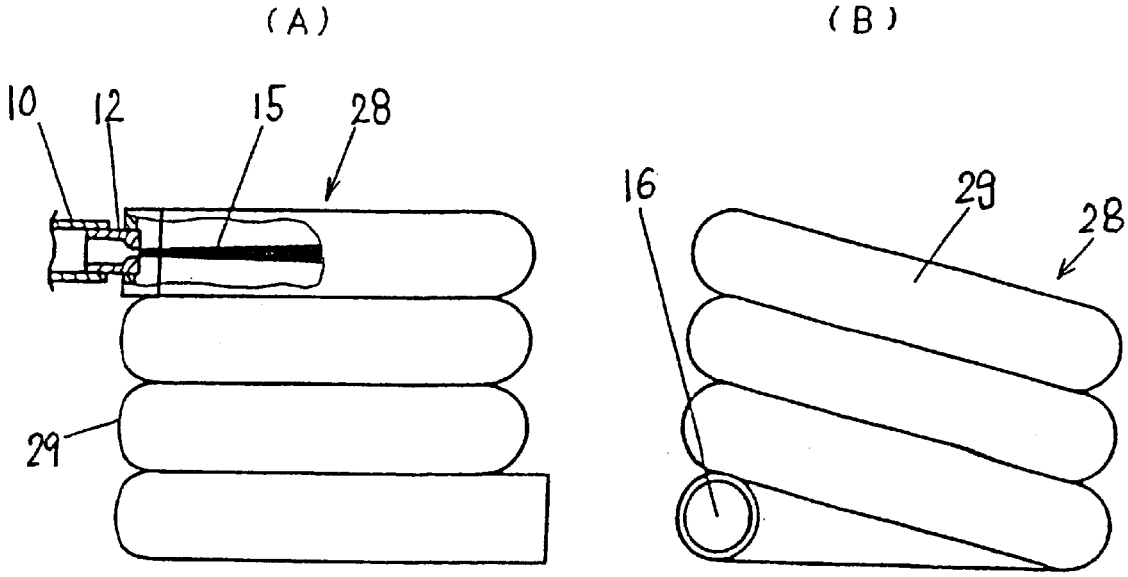
FIG. 4(A) and FIG. 4(B) are partially cutaway front view and a ride side view, respectively, of an apparatus for dissolving and mixing a gas and a liquid according to a third embodiment of the present invention.

FIG. 4 shows an apparatus for dissolving and mixing a gas and a liquid according to a third embodiment of the present invention. In this embodiment, a mixing container 28 is formed by a pipe line 29 in the form of a loop. An action equivalent to that of the diaphragm 25 in the second embodiment can be also obtained in the present embodiment by forming the inner diameter of the pipe line 29 that is continuous with the nozzle 12 in a size 10 to 20 times larger than the diameter of the jet 15, from which a similar effect can be expected. The present embodiment is similar to the first embodiment with respect to other various conditions and the manner in which it is used.

Although the pipe line 29 in the present embodiment has a spiral configuration, the configuration of the pipe line 29 may be arbitrarily set as long as the jet of liquid is injected from the nozzle 12 in a horizontal direction at a flow rate of 5.0 m/s or more; the fluid exit port 16 is located below the entrance of the jet 15; and the restriction is provided downstream thereof. In this case, the liquid level is also preferably in the vicinity of the opening of the nozzle as described in the first embodiment.

Figure 5:
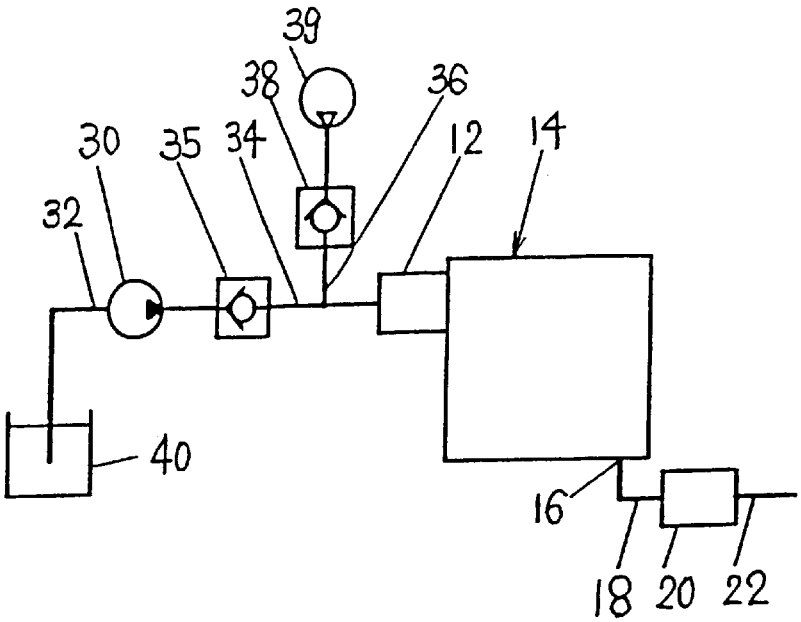
FIG. 5 is a schematic view showing an apparatus for dissolving and mixing a gas and a liquid according to a fourth embodiment of the present invention.

FIG. 5 shows an apparatus for dissolving and mixing a gas and a liquid according to a fourth embodiment of the present invention. Parts identical to the above-described embodiments will be indicated by like reference numbers and will not be described here. FIG. 5 shows the configuration of the apparatus as a whole. In the present embodiment, a supply pipe line 32 and a discharge pipe line 34 are connected to a pump 30. A check valve 35 is provided halfway the discharge pipe line 34, and a gas pipe line 36 as a gas injection means is connected halfway downstream thereof. The discharge pipe line 34 is connected to the nozzle 12 and is connected to an upper part of the mixing container 14 which hermetically contains a gas in a pressurized state. A compressor 39 as a gas injection means is connected to the gas pipe line 36 through a check valve 38. The pipe line 18 is connected to the exit port 16 at a lower part of the mixing container 14, and the pipe line 18 is connected to the pipe line 22 through the restrictor 20. As the restrictor 20, various types of variable restrictors such as valves may be used. The gas pipe line 36 may be connected to an upper part of the mixing container 14 instead of the upstream of the nozzle 12.

Referring to the operation of the apparatus for dissolving and mixing a gas and a liquid according to the present embodiment, a liquid absorbed by the pump 30 from a source liquid bath 40 through the supply pipe line 32 is delivered by the pump 30 and flows into the nozzle 12 through the discharge pipe line 34. The liquid is accelerated by the nozzle 12 as in the above-described embodiments to be delivered into the mixing container 14 as a jet. The mixing container 14 is filled with a gas in advance, and the volume of the gas is compresses by the liquid that flows in to establish a pressurized state in the mixing container 14. A reaction or dissolution occurs between the injected liquid and the gas which has been filled in the mixing container 14 in a pressurized state. The present embodiment is similar to the first embodiment with respect to various other conditions and the manner in which it is used.

In the present embodiment, when the gas inside the mixing container 14 is consumed and falls short as a result of the reaction or dissolution between the gas and liquid, the pump 30 is stopped to reduce the pressure in the mixing container 14 and the compressor 39 replenishes the mixing container 14 with the gas. After the gas is replenished, the pump 30 is restarted with the compressor 39 stopped. Although the compressor 39 is used as a gas pumping means, other pumping means such as a gas cylinder may be used. Since the check valve 38 is provided halfway the gas pipe line 36 that extends from the compressor 39, no liquid flows back to the compressor 39 during pumping. Further, since the check valve 35 is provided halfway the discharge pipe line 34, no gas flows back to the pump 30 during the replenishment of the gas.

The gas is replenished with the pumping using the pump 30 stopped because this is advantageous in that the liquid pumping means is relieved from a heavy load and the power required for pumping the gas can be saved especially when continuous dissolution or mixing of the gas and liquid is not required. In this embodiment, a liquid level close to the position of the nozzle opening also allows a more efficient reaction or dissolution between the gas and liquid during a normal operation. Further, a diaphragm may be provided in the vicinity of the opening of the nozzle 12 of the mixing container 14 as in the above-described second embodiment.

Figure 6:
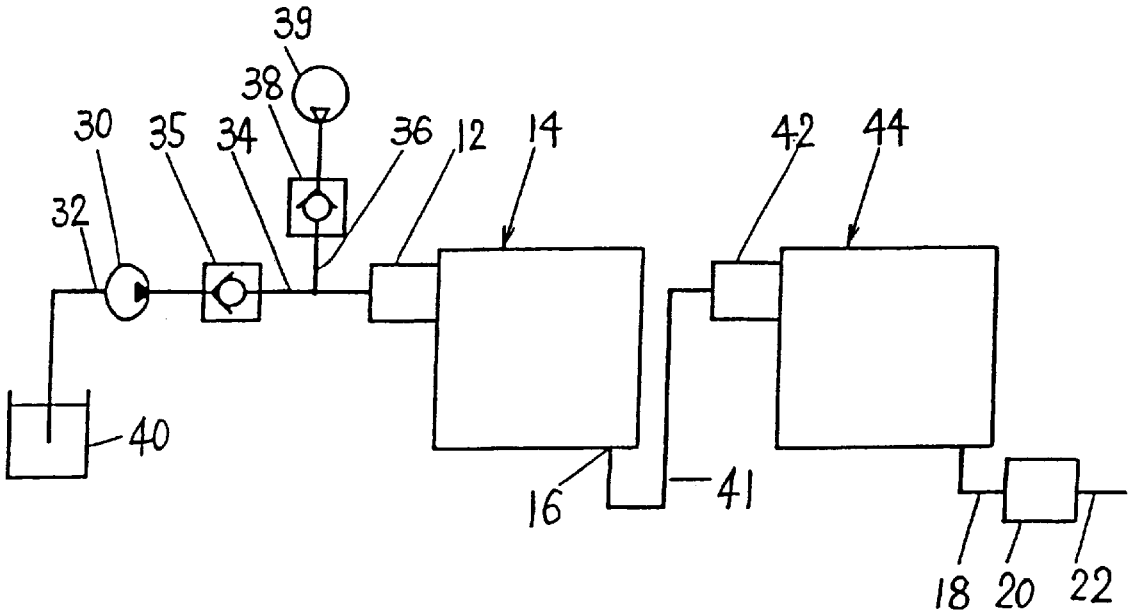
FIG. 6 is a schematic view showing an apparatus for dissolving and mixing a gas and a liquid according to a fifth embodiment of the present invention.

FIG. 6 shows an apparatus for dissolving and mixing a gas and a liquid according to a fifth embodiment of the present invention. Parts identical to the above-described embodiments will be indicated by like reference numbers and will not be described here. The present embodiment has the same configuration as that of the fourth embodiment except that two pairs of nozzle 12 and mixing container 14 are connected in series through a pipe line 41. As shown in FIG. 6, a pipe line 41 from an exit port 16 of a mixing container 14 is connected to a nozzle 42 which is similar to the nozzle 12, and the nozzle 42 is connected to a mixing container 44 which is similar to the mixing container 14. The number of the pairs of the series—connected nozzle and mixing container can be arbitrarily set. The present embodiment is similar to the first embodiment with respect to various other conditions and the manner in which it is used.

In the present embodiment, the two pairs of nozzles 14 and mixing containers 14 are connected in series to allow contact between a gas and a liquid at a level which is twice that available in the case of one set. An increase in the number of such sets result in an corresponding increase in the contact between a gas and a liquid.

Figure 7:
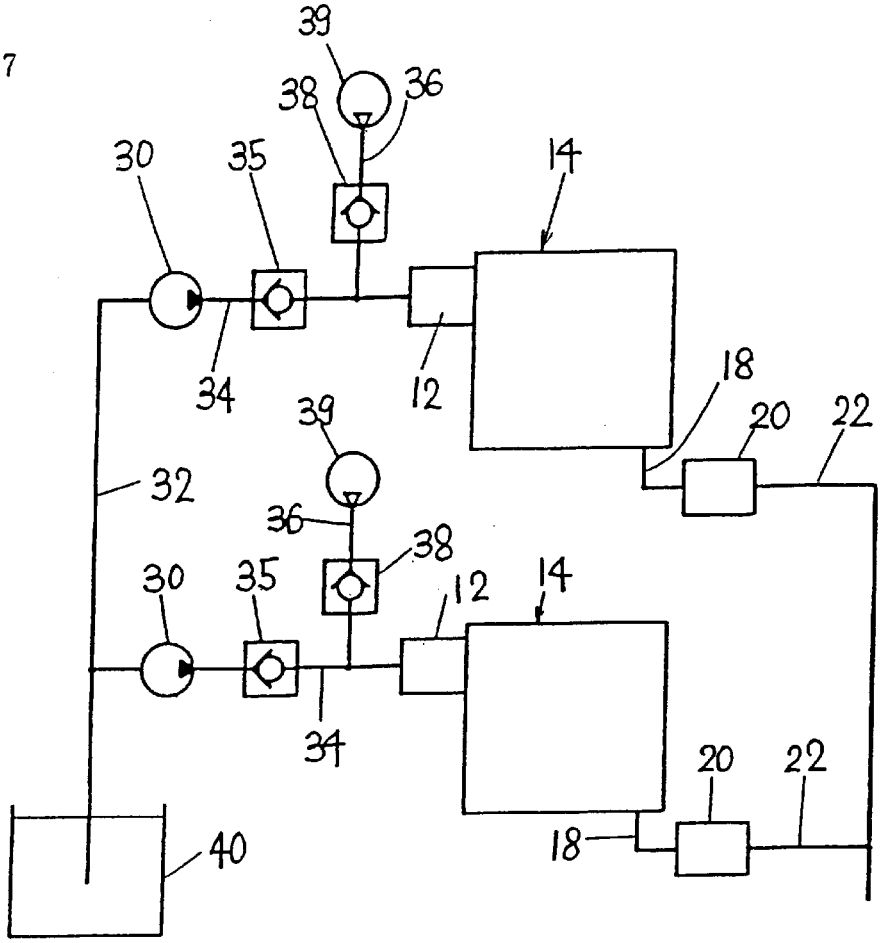
FIG. 7 is a schematic view showing an apparatus for dissolving and mixing a gas and a liquid according to a sixth embodiment of the present invention.

FIG. 7 shows an apparatus for dissolving and mixing a gas and a liquid according to a sixth embodiment of the present invention. Parts identical to the above-described embodiments will be indicated by like reference numbers and will not be described two sets of the apparatuses for dissolving and mixing a gas and a liquid according to the fourth embodiment are connected in parallel. The apparatuses for dissolving and mixing a gas and a liquid according to this embodiment are used by operating one of the apparatuses while the other is stopped for replenishing the gas. This makes it possible to provide an apparatus for dissolving and mixing a gas and a liquid which can be continuously operated without dead time for replenishing the gas. It is also possible in the present embodiment to provide three or more apparatuses may be provided in parallel. Various other conditions are similar to those in the above described embodiments.

Figure 8:
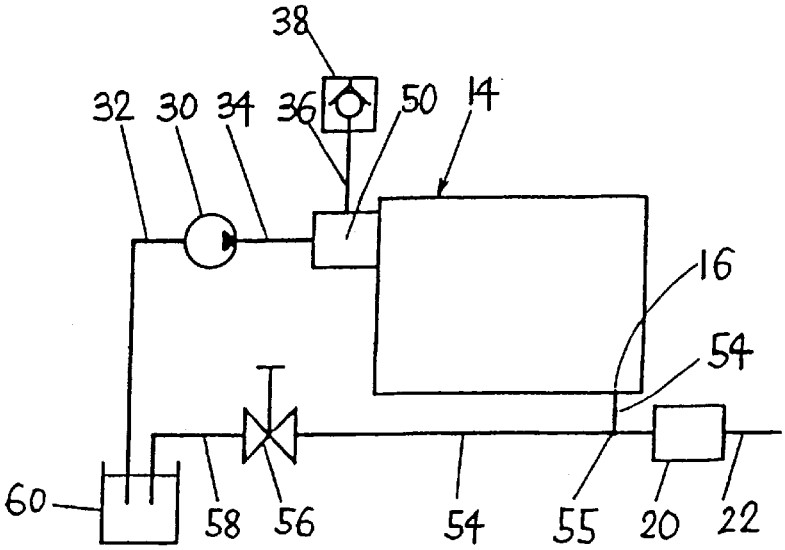
FIG. 8 is a schematic view showing an apparatus for dissolving and mixing a gas and a liquid according to a seventh embodiment of the present invention.

FIGS. 8 through 11 show an apparatus for dissolving and mixing a gas and a liquid according to a seventh embodiment of the present invention. Parts identical to the above-described embodiments will be indicated by like reference numbers and will not be described here. In the present embodiment, as shown in FIG. 8, a supply pipe line 32 connected to a liquid source 60 is provided on the suction side of a pump 30, and a discharge pipe line 34 is connected to the discharge side of the pump 30. A suction device 50 as an injection portion is connected to the downstream end of the discharge pipe line 34, and the suction device 50 is connected to an upper part of a mixing container 14. A gas pipe line 36 is connected to the suction device 50 through a check valve 38.

A pipe line 54 is connected to an exit port 16 at a lower part of the mixing container 14, and one of branch points 55 of the pipe line 54 is connected to a discharge pipe line 22 through a restrictor 20. The other pipe line 54 from the branch point 55 is connected to a pipe line 58 through an on-off valve 56. The pipe line 58 is connected to the liquid source 60.

Figure 11:
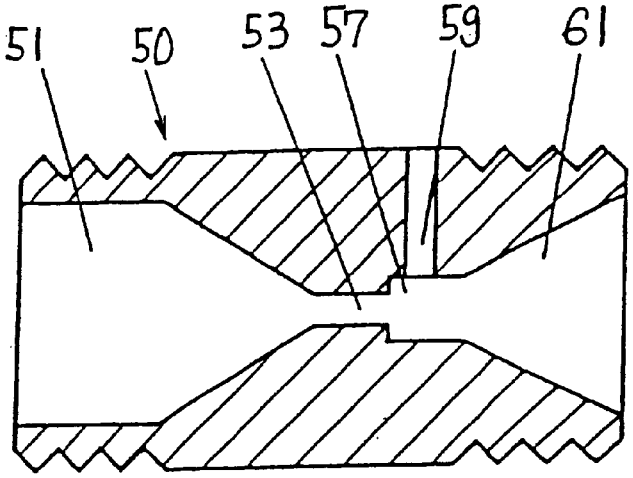
FIG. 11 is a sectional view showing a suction device of the apparatus for dissolving and mixing a gas and a liquid according to the first embodiment of the present invention.

As shown in FIG. 11, the suction device 50 is in the form of a venturi tube in the part thereof downstream a liquid intake port 51. Downstream of a restriction portion (throat portion) 53, there is provided a cylindrical suction portion 57 which is concentric with the restriction portion (throat portion) 53 and which has an inner diameter slightly larger than the same. A gas intake port 59 is opened into the suction portion 57. An expanded portion 61 is formed downstream of the gas intake port 59, and the expanded portion 61 opens at an upper part of the mixing container 14.

Figure 9:
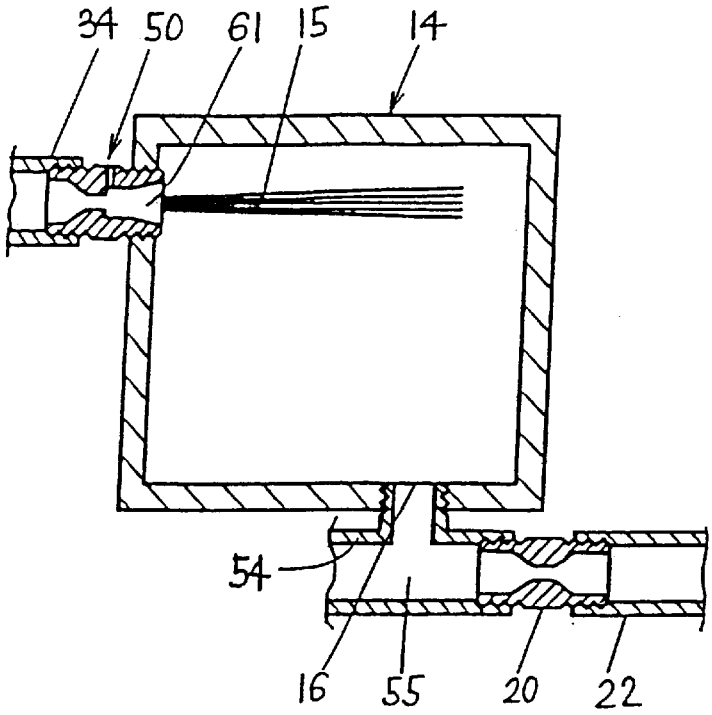
FIG. 9 is a sectional view of the apparatus for dissolving and mixing a gas and a liquid according to the seventh embodiment of the present invention.
Figure 10:
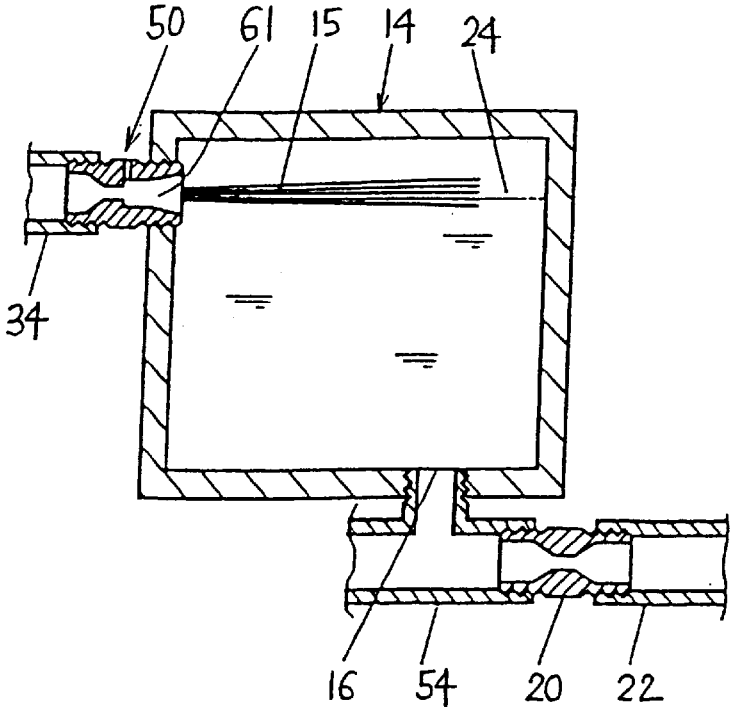
FIG. 10 is a sectional view showing a state of the apparatus for dissolving and mixing a gas and a liquid according to the seventh embodiment of the present invention in use.

In the apparatus for dissolving and mixing a gas and a liquid in the present embodiment, a liquid absorbed by the pump 30 from the liquid source 60 through the supply pipe line 32 is delivered by the pump 30 into the suction device 50 through the discharge pipe line 34. The liquid is accelerated by the suction device 50 and is delivered into the mixing container 14 as a jet 15 as shown in FIG. 9. Like the above-described embodiments, a reaction or dissolution occurs between the injected liquid and the gas filled therein. The conditions are the same as those in the first embodiment, and the gas and liquid are brought into contact with each other in an efficient manner when the liquid level is close to the expanded portion 61 which is the injection port for the jet 15, as shown in FIG. 10.

In the present embodiment, when the gas falls short as a result of the reaction or dissolution between the gas and liquid, the on-off valve 56 is opened to suck the gas. When the on-off valve 56 is opened, the restrictor 20 becomes ineffective. As a result, the interior of the mixing container 14 is depressurized and a negative pressure is produced in a gas intake portion 57 of the suction device 50. Thus, external gas is absorbed into the mixing container 14 through the suction device 50. In the mixing container 14, since the exit port 16 is provided at a lower part thereof, the liquid flows out in precedence to the gas and the gas is absorbed into the space thus produced. After the gas is replenished, the on-off valve 56 is closed to restore the effect of the restrictor 20. Then, the pressure of the gas inside the mixing container is increased as the liquid flows therein as described above to cause dissolution and mixing of the gas and liquid. This process is repeated thereafter as needed.

Figure 12:
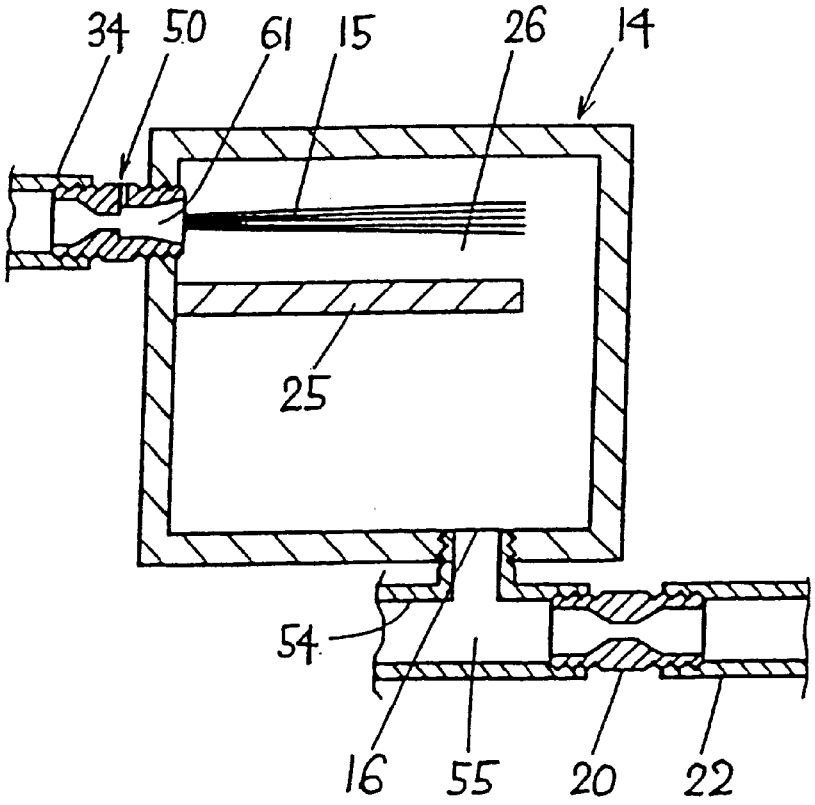
FIG. 12 is a sectional of an apparatus for dissolving and mixing a gas and a liquid according to an eighth embodiment of the present invention in use.

FIG. 12 shows an apparatus for dissolving and mixing a gas and a liquid according to an eighth embodiment of the present invention. Parts identical to the above-described embodiments will be indicated by like reference numbers and will not be described here. As shown in FIG. 12, the present embodiment includes a duct portion formed by providing a diaphragm in the region where the jet 15 flows in from the suction device 50. It has a configuration similar to that in the seventh embodiment and operates similarly under similar conditions.

In the present embodiment, as described above, the jet 15 is confined in a narrow space by the diaphragm 25 to allow a high level of contact between the gas and liquid. In this case, it is also desirable that the size of the duct portion 26 is set 10 to 20 times larger than the diameter of the jet 15.

Figure 13:
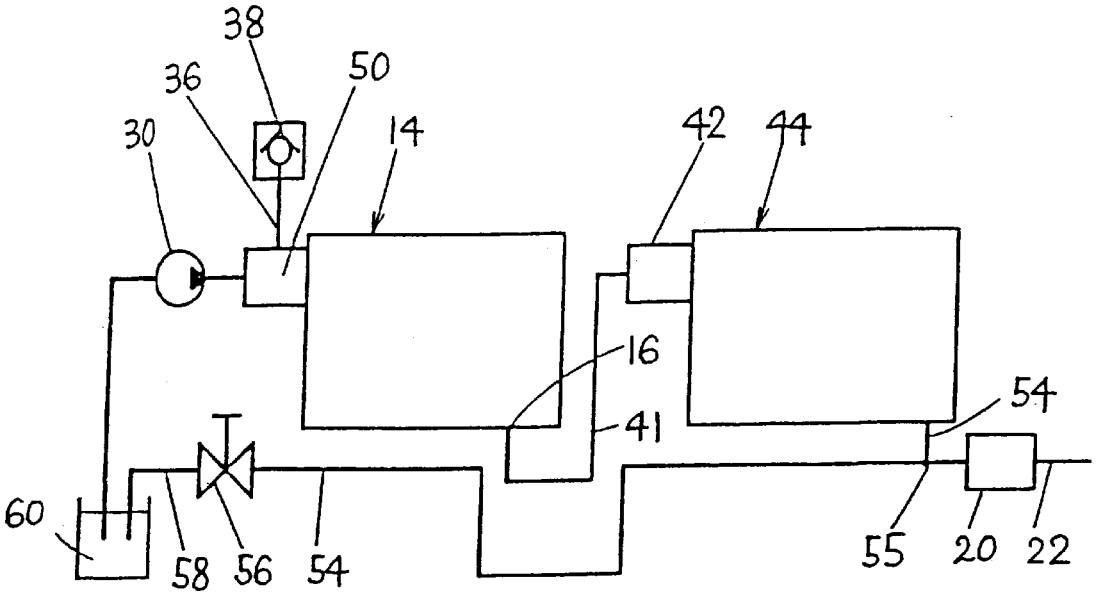
FIG. 13 is a schematic view showing an apparatus for dissolving and mixing a gas and a liquid according to a ninth embodiment of the present invention.

FIG. 13 shows an apparatus for dissolving and mixing a gas and a liquid according to a ninth embodiment of the present invention. Parts identical to the above-described embodiments for carrying out the invention will be indicated by like reference numbers and will not be described here. As shown in FIG. 13, according to this embodiment, a suction device 50 and a mixing container 14 are provided in series downstream of an exit port 16; a gas pipe line 36 is provided in front of a suction device 50 upstream of the same; and a restrictor 20 is provided downstream of the downstream mixing container 14. Although two pairs of suction device 50 and mixing container 14 are provided in this embodiment, the number of such pairs may be increased appropriately. Further, a nozzle may be connected to an upper part of the mixing container 14 instead of the suction device 50 at the downstream side of the second stage and thereafter. Various other conditions are the same as those in the first embodiment.

In the present embodiment, a higher level of contact between a gas and a liquid is achieved by connecting the suction devices 50 and mixing containers 14 in series to form a multiplicity of stages.

Figure 14:
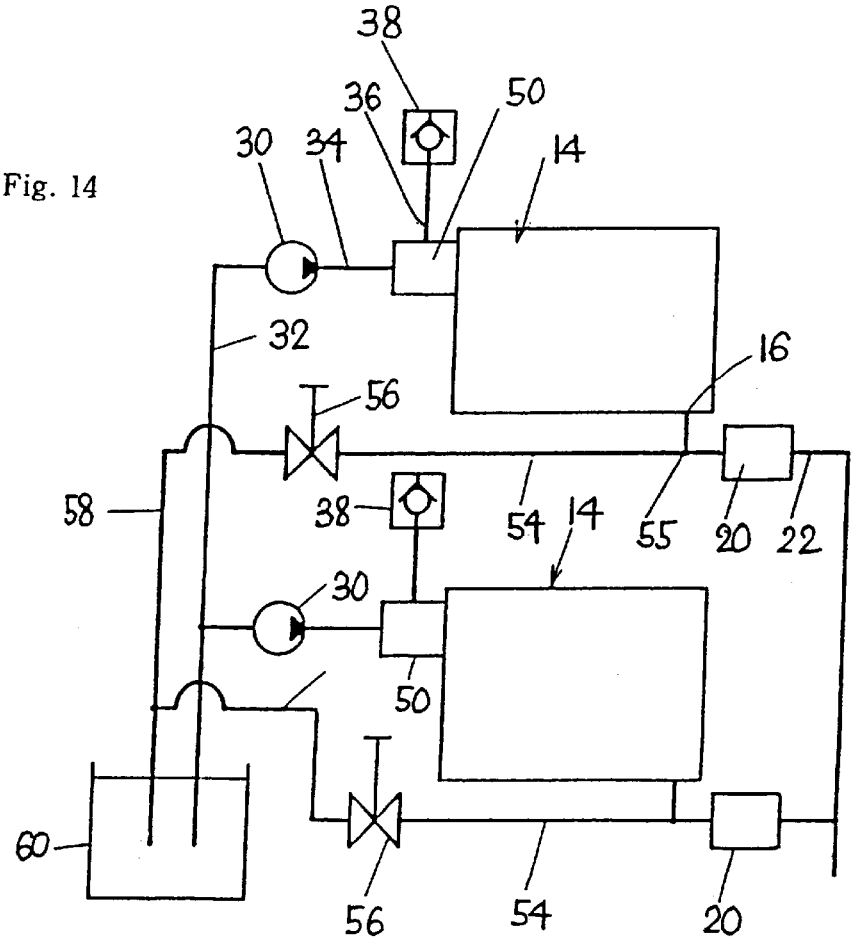
FIG. 14 is a schematic view showing an apparatus for dissolving and mixing a gas and a liquid according to a tenth embodiment of the present invention.

FIG. 14 shows an apparatus for dissolving and mixing a gas and a liquid according to a tenth embodiment of the present invention. Parts identical to the above-described embodiments for carrying out the invention will be indicated by like reference numbers and will not be described here. As shown in FIG. 14, according to this embodiment, two sets of apparatuses for dissolving and mixing a gas and a liquid are provided in parallel. This makes it possible to realize an apparatus for dissolving and mixing a gas and a liquid which can be continuously operated without being stopped for replenishing the gas by operating one of the apparatuses while the other apparatus is stopped for replenishing the gas. Three or more apparatuses may be provided in parallel. Various other conditions are the same as those in the first embodiment.

Figure 15:
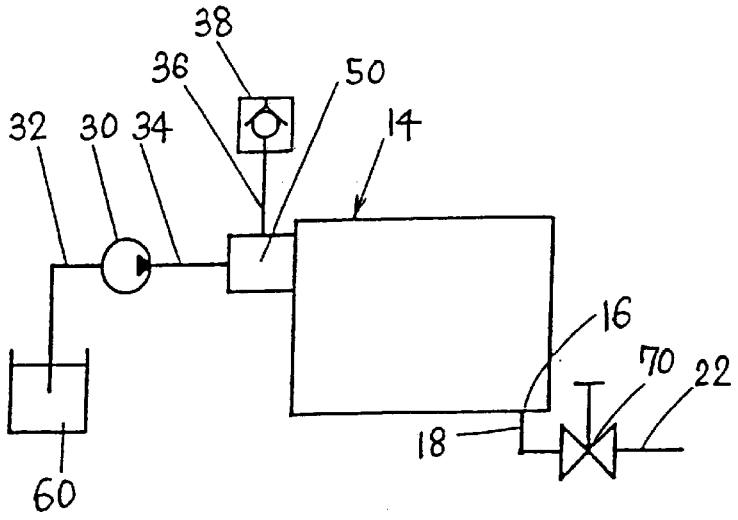
FIG. 15 is a schematic view showing an apparatus for dissolving and mixing a gas and a liquid according to an eleventh embodiment of the present invention.

FIG. 15 shows an apparatus for dissolving and mixing a gas and a liquid according to a eleventh embodiment of the present invention. Parts identical to the above-described embodiments for carrying out the invention will be indicated by like reference numbers and will not be described here. As shown in FIG. 15, according to this embodiment, a pressure adjusting valve 70 is provided instead of the restrictor 20 in the seventh embodiment to delete the pipe line for decompression that follows the branch point in the seventh embodiment. In the present embodiment, the pressure adjusting valve 70 is opened to reduce the pressure inside the mixing container 14 when the gas is sucked by the suction device 50 and, a pressurized state is established in the mixing container 14 by closing the pressure adjusting valve 70. Various other conditions are the same as those in the first embodiment.

Figure 16:
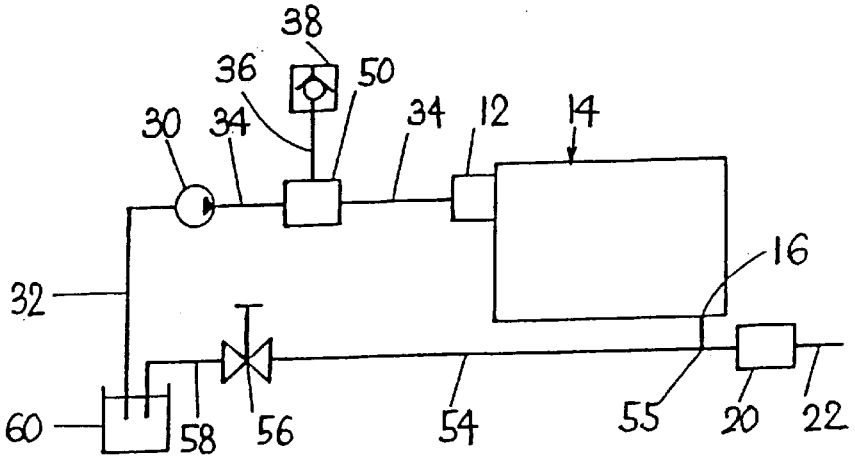
FIG. 16 is a schematic view showing an apparatus for dissolving and mixing a gas and a liquid according to an twelfth embodiment of the present invention.
Figure 17:
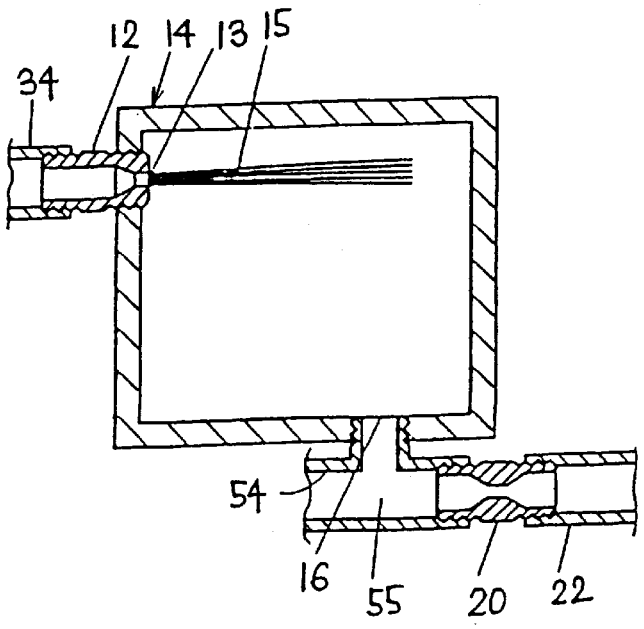
FIG. 17 is a sectional view of the apparatus for dissolving and mixing a gas and a liquid according to the twelfth embodiment.

FIGS. 16 and 17 show an apparatus for dissolving and mixing a gas and a liquid according to a twelfth embodiment of the present invention. Parts identical to the above-described embodiments for carrying out the invention will be indicated by like reference numbers and will not be described here. As shown in FIG. 16, according to this embodiment, a suction device 50 as in the seventh embodiment is provided halfway the discharge pipe line 34, and a nozzle 12 is mounted on the discharge pipe line 34 and is connected to an upper part of the mixing container 14. Various other conditions are the same as those in the first embodiment.

It is desirable that the sectional area of an opening 13 of the nozzle 12 in this embodiment is sufficiently larger than the sectional areas of a throat portion 53 of the suction device 50 and a restrictor 20 and that the flow rate of a jet 15 is within the range from 5 m/s to 15 m/s. Especially, it is desirable that the sectional are of the opening 13 at the exit of the nozzle 12 is 1.5 times the sectional areas of the throat portion 53 and restrictor 20 or more. Various other conditions are the same as those in the first embodiment.

In the apparatus for dissolving and mixing a gas and a liquid according to the present embodiment, no back-flow of the gas inside the mixing container 14 occurs while the liquid is being ejected from the nozzle 12 even if there is leakage at the check valve 38 and gas pipe line 36.

Figure 18:
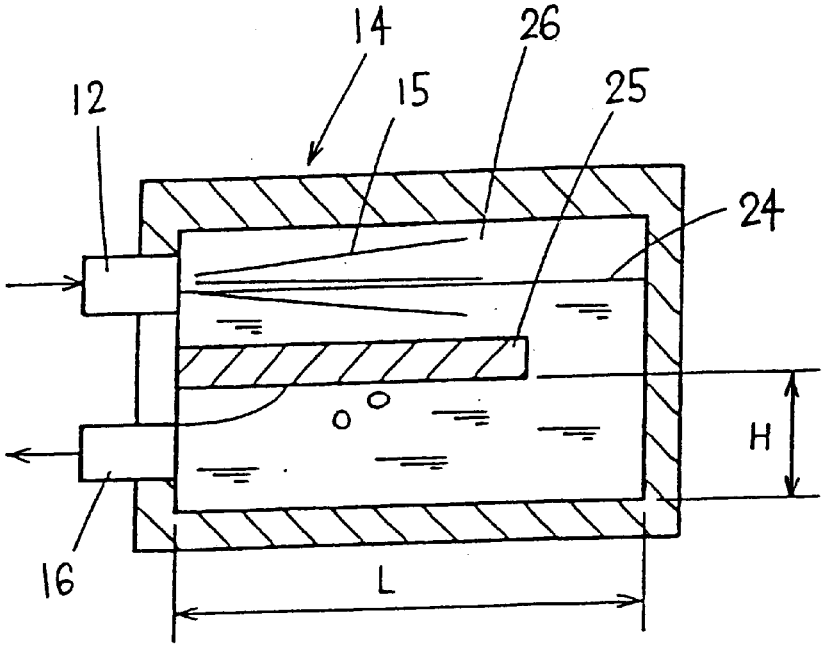
FIG. 18 is a sectional view of a mixing container of an apparatus for dissolving and mixing a gas and a liquid according to a thirteenth embodiment.
Figure 19:
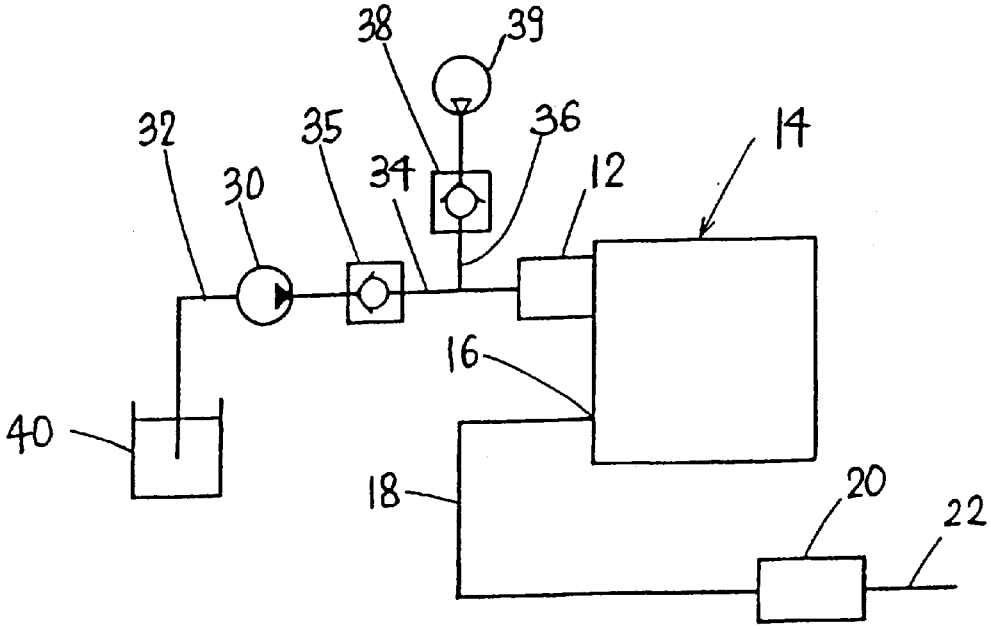
FIG. 19 is a schematic view showing the apparatus for dissolving and mixing a gas and a liquid according to the thirteenth embodiment.

FIGS. 18 and 19 show an apparatus for dissolving and mixing a gas and a liquid according to a thirteenth embodiment of the present invention. The apparatus for dissolving and mixing a gas and a liquid of the present embodiment is provided by moving the mounting position of the exit port 16 of the apparatus for dissolving and mixing a gas and a liquid according to the second embodiment to a lower part of the mixing container 14 which is below the diaphragm 25 in the mixing container 14 and directly under the nozzle 12. A supply pipe line 32 and a discharge pipe line 34 are connected to a pump 30. A check valve 35 is provided halfway the discharge pipe line 34 and a gas pipe line 36 as a gas injection means is connected downstream thereof. The discharge pipe line 34 is connected to the nozzle 12 and to an upper part of the hermetic mixing container 14 in which a gas is hermetically contained in a pressurized state. A compressor 39 as a gas injection means is connected to the gas pipe line 36 through a check valve 38. A pipe line 18 is connected to an exit port 16 directly under the nozzle 12 and is connected to a pipe line 22 through a restrictor 20. A variable restrictor such as various types of valves may be used as the restrictor 20, and the gas pipe line 36 may be connected to an upper part of the mixing container 14 instead upstream of the nozzle 12.

The reason for such positioning of the exit port 16 of the present embodiment is the fact that a problem has arisen in that when the exit port 16 is provided opposite to the position shown in FIG. 18 or in the vicinity of the wall surface facing the injecting direction of the liquid, the gas which has not been dissolved flows out as bubbles along with the liquid from the exit port provided in such a position, reducing the utilization of the gas and forming a mixed flow of the gas and liquid including large bubbles. If the exit port 16 is positioned directly under the nozzle 12 as in the present embodiment, a flow caused by a jet 15 is not directed to the exit port 16 and bubbles resulting from insufficient dissolution are collected on the rear side of a diaphragm 25 during the travel of the mixed flow of the gas and liquid toward the exit port 16 and do not easily flow out from the exit port 16. The collected bubbles are appropriately released upward to prevent the gas from being wastefully emitted.

Referring to conditions to collect the bubbles on the rear side of the diaphragm 25, when the flow rate in the channel below the mixing container 14 is 0.1 m/s or less, a relationship L/H>4 is preferably satisfied where the height H and length L of the channel below the mixing container 14 in FIG. 18. The exit port 16 may be positioned on wall surfaces other than the wall surface facing the injecting direction of the liquid and wall surfaces in the vicinity thereof. Further, if the diaphragm 25 is slightly inclined to raise its end opposite to the exit port 16, the bubbles naturally flow upward and move toward the upper part of the mixing container 14. The present embodiment is the same as the first, second and fourth embodiments with respect to other conditions and the manner in which it is used. A suction device 50 as in the above-described embodiments may be used instead of the nozzle 12.

Figure 20:
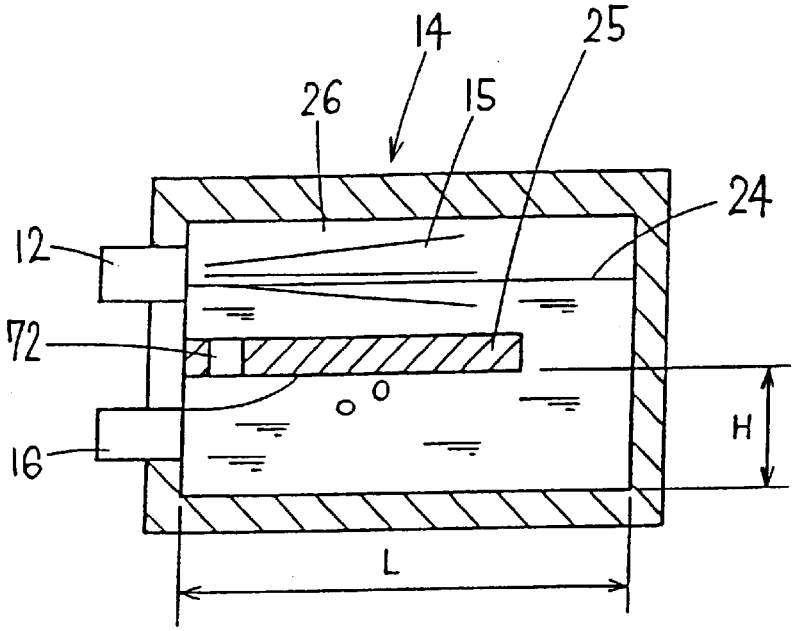
FIG. 20 is a sectional view of a mixing container of an apparatus for dissolving and mixing a gas and a liquid according to a fourteenth embodiment.
Figure 21:
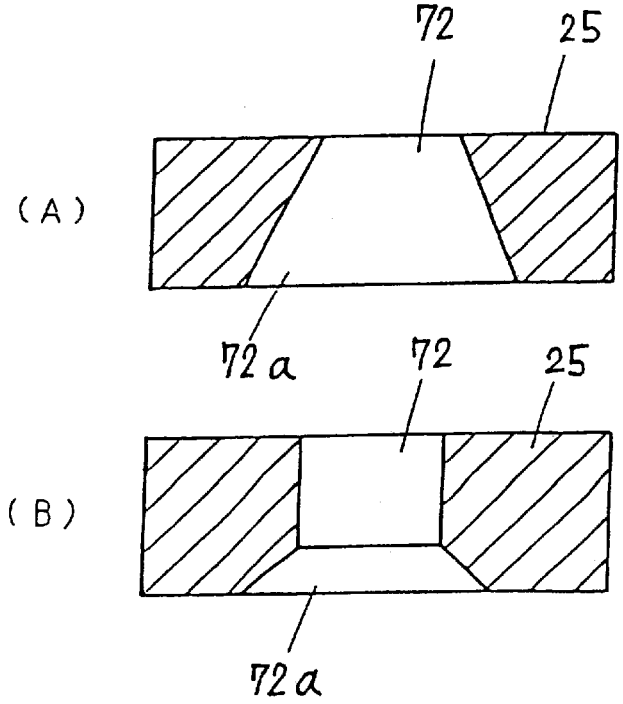
FIG. 21 is a sectional view of a through hole portion of a diaphragm of the apparatus for dissolving and mixing a gas and a liquid according to the fourteenth embodiment.

FIGS. 20 and 21 show a fourteenth embodiment of the present invention. The apparatus for dissolving and mixing a gas and liquid of the present embodiment is provided by forming a through hole 72 in the vicinity of an exit port 16 of a diaphragm 25 of a mixing container of an apparatus for dissolving and mixing a gas and a liquid according to the thirteenth embodiment.

This allows bubbles collected on the rear side of the diaphragm 25 to move upward through the through hole 72 to an upper part of the mixing container 14 to be subjected to mixing with a liquid. This ensures that bubbles flowing out from the exit port 16 are eliminated for efficient utilization of the gas.

Instead of the configuration shown in FIG. 20, the through hole 72 formed on the diaphragm 25 may be entirely or partially formed with a truncated conical portion 72*a* which is wider on the as shown in FIGS. 21(A) and 21(B) to allow bubbles to more easily move toward the through hole 72 through the truncated conical portion 72*a* and to float upwardly.

Figure 22:
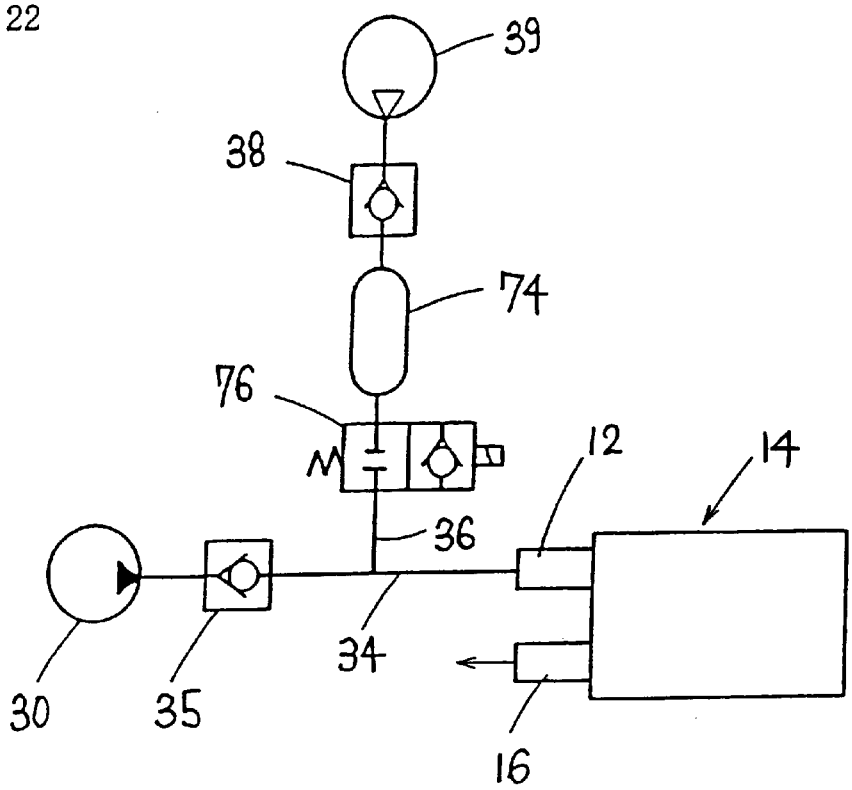
FIG. 22 is a schematic view showing an apparatus for dissolving and mixing a gas and a liquid according to an fifteenth embodiment.

FIG. 22 shows a fifteenth embodiment of the present invention. The apparatus for dissolving and mixing a gas and liquid of the present embodiment is realized by providing a gas tank 74 as a gas injection means on a gas pipe line 36 between a check valve 38 and a discharge pipe line 34 of apparatus for dissolving and mixing a gas and a liquid according to the fourth embodiment shown in FIG. 5 and by providing an solenoid valve 76 on the gas pipe line 36 between the gas tank 74 and discharge pipe line 34.

According to the present embodiment, the gas tank 74 is filled with a pressurized gas by operating a compressor 39 while a liquid is being pumped by a pump 30. When the gas in the mixing container 14 begins to fall short, the pump 30 and compressor 39 are stopped and the solenoid valve 76 is switched to fill the mixing container 14 with the gas in the gas tank 74. The pressure of the gas in the gas tank 74 is made substantially equal to the pressure in the gas in the mixing container 14, and the gas in the gas tank 74 is charged into the mixing container 14 as the liquid in the mixing container 14 flows out.

This prevents the liquid in the mixing container 14 from flowing out at a time and allows it to flow out reliably and continuously. Further, since the compressor 39 pressurizes the gas and fills the gas tank 74 with it while the liquid is being pumped, i.e., the solenoid valve 76 is closed, the pump 30 pumping the liquid is stopped only for a quite short period of time compared to the fourth embodiment shown in FIG. 5. Specifically, there has been a problem in that since the compressor 39 takes a long time for actuation, a long rise time is spent before the compressor 39 achieves a gas pressure equal to that of the gas in the mixing container 14 if it is actuated after the pump 30 is stopped. In the present embodiment, however, since the actuation is effected when the pump 30 is in operation, the pump 30 is required to stop to allow the charging of the gas only for a period, for example, on the order of several seconds.

Figure 23:
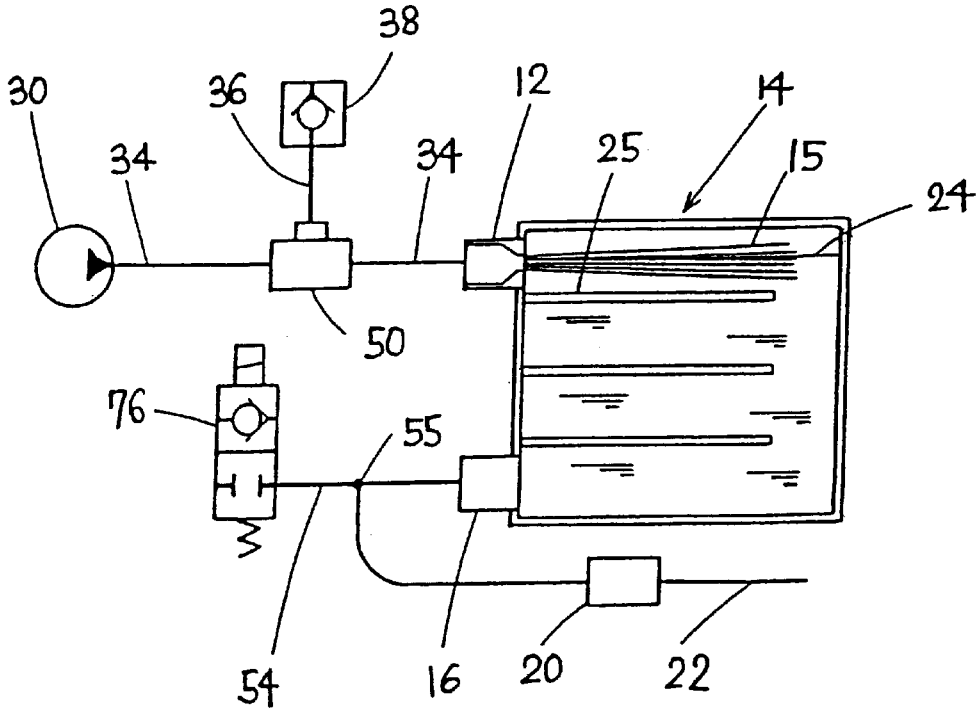
FIG. 23 is a schematic view showing an apparatus for dissolving and mixing a gas and a liquid according to an sixteenth embodiment.

Next, FIG. 23 shows a sixteenth embodiment of the present invention. Parts identical to those in the above-described embodiments are indicated by like reference numbers and will not be described. According to the present embodiment, as shown in FIG. 23, a suction device 50 as in the seventh embodiment is provided halfway a discharge pipe line 34, and a nozzle 12 is mounted to the end of the discharge pipe line 34 and is connected to an upper part of the mixing container 14. Further, in the apparatus for dissolving and mixing a gas and a liquid of the present embodiment, an on-off valve 56 as in the twelfth embodiment is replaced with an solenoid valve 76. The configuration of the present embodiment is otherwise similar to those in the first, seventh and twelfth embodiments and various other conditions are the same as those in the above-described embodiments.

It is desirable that the sectional area of an opening 13 of the nozzle 12 in this embodiment is sufficiently larger than the sectional areas of a throat portion 53 of the suction device 50 and a restrictor 20 and that the flow rate of a jet 15 is within the range from 5 m/s to 15 m/s. Especially, it is desirable that the sectional are of the opening 13 at the exit of the nozzle 12 is 1.5 times the sectional areas of the throat portion 53 and restrictor 20 or more.

According to the present embodiment, the liquid can be injected and the gas can be supplied automatically by switching the solenoid valve 76 without the need for a compressor.

Figure 24:
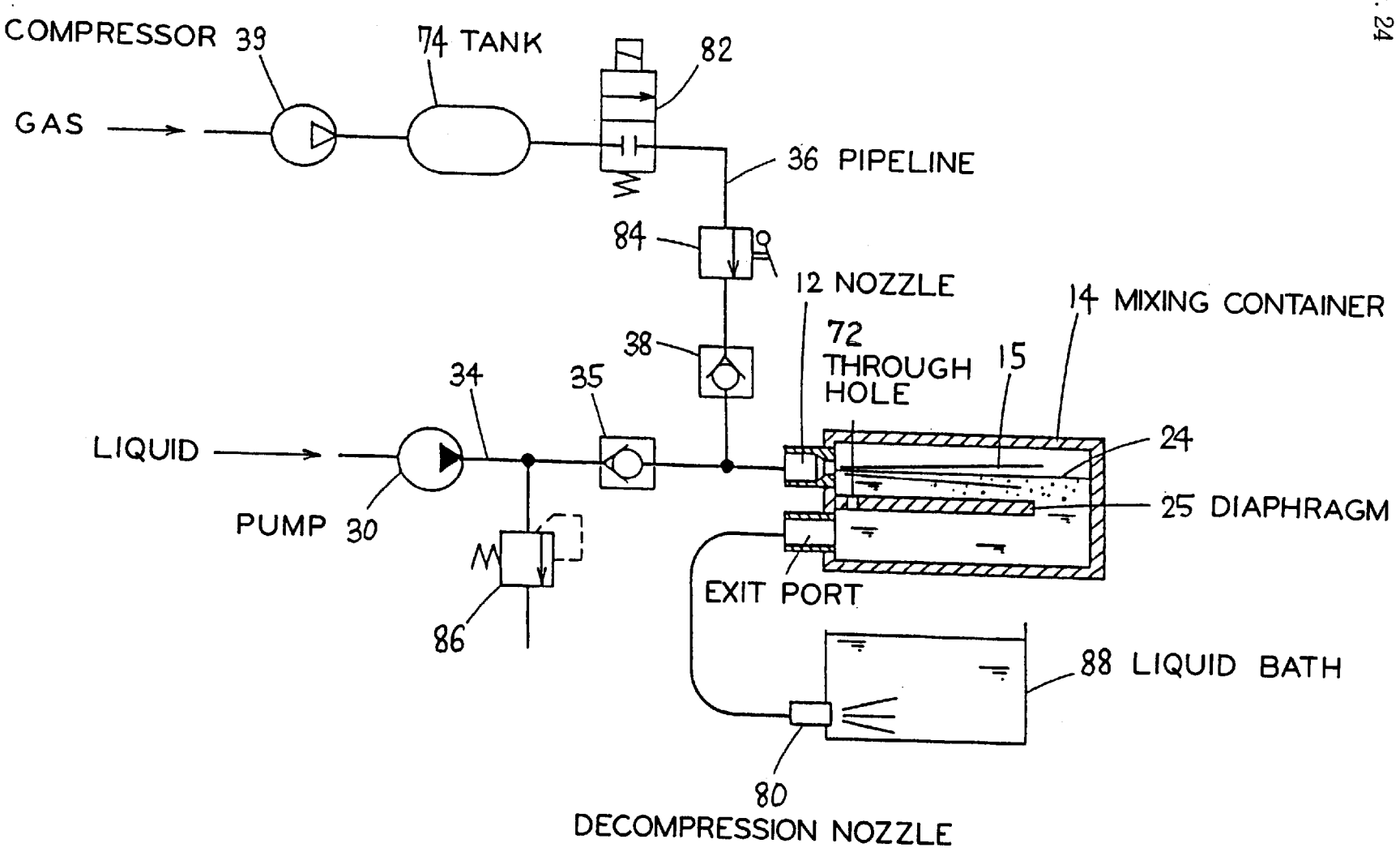
FIG. 24 is a schematic view of a apparatus for dissolving and mixing a gas and a liquid according to a seventeenth embodiment.
Figure 25:
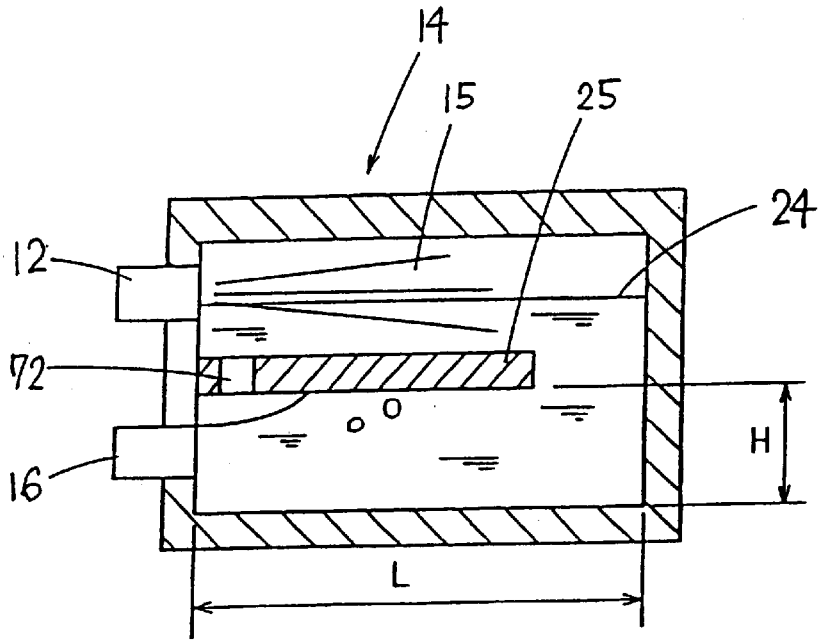
FIG. 25 is a sectional view of a mixing container of the apparatus for dissolving and mixing a gas and a liquid according to the seventeenth embodiment.
Figure 26:
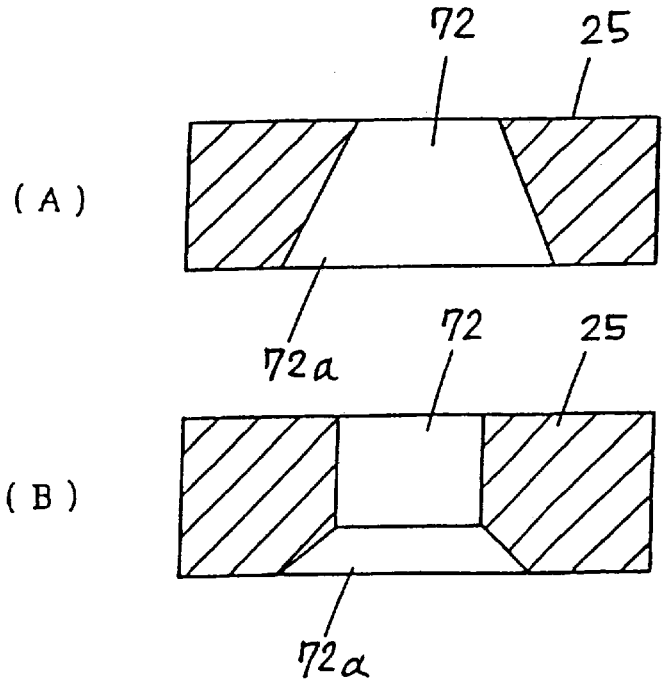
FIG. 26 is a sectional view of a through hole portion of a diaphragm of the apparatus for dissolving and mixing a gas and a liquid according to the seventeenth embodiment.

Next, FIGS. 24 through 26 show a seventeenth embodiment of the present invention. Parts identical to those in the above-described embodiments are indicated by like reference numbers and will not be described. According to the present embodiment, a nozzle 12 as an injection portion connected to an end of a pipe line 34 for supplying a liquid is connected to an upper part on one side of a mixing container 14 formed hermetically. An exit port 16 is formed at a lower part of the side of the mixing container 14. The exit port is connected through a pipe line 18 to a decompression nozzle 80 as a restrictor which opens on a side wall of a liquid bath 88 for collecting a processed liquid including the gas dissolved therein.

A pump 30 for supplying a liquid is connected to the upstream side of the pipe line 34, and a check valve 35 is provided halfway the pipe line 34 extending from the pump 30 to the nozzle 12 for allowing a flow toward the nozzle 12. Further, a pipe line 36 is connected between the check valve 35 and the nozzle 12, and a compressor 39 as a gas supply device, a gas tank 74 for storing a gas, and solenoid valve 82, and a valve 84 and a check valve 38 as restrictors are provided in series in the order listed along the pipe line 36.

A diaphragm 25 is provided in the mixing container 14 for separating the interior of the container over a predetermined distance from the side to which the nozzle 12 is connected. A through hole 72 is formed on the end of the diaphragm 25 toward the nozzle 12. The diaphragm 25 is provided to prevent a liquid in which a gas is insufficiently dissolved or which has been reacted with a gas insufficiently from going out through the exit port 16. The through hole 72 returns the gas collected at the lower part on the rear side of the diaphragm 25 to the upper part to recycle it for dissolution or reaction between the gas and liquid. These parts reduce bubbles that wastefully flow out through the exit port 16 to allow more efficient utilization of the gas.

Instead of the configuration shown in FIG. 25, the through hole 72 formed on the diaphragm 25 may be entirely or partially formed with a truncated conical portion 72*a* which is wider on the as shown in FIGS. 21(A) and 21(B) to allow bubbles to more easily move toward the through hole 72 through the truncated conical portion 72*a* and to float upwardly.

The reason for such positioning of the exit port 16 under the nozzle 12 of the present embodiment is the fact that a problem has arisen in that when the exit port 16 is provided in the vicinity of the wall surface facing the injecting direction of the liquid which is opposite to the position shown in FIGS. 24 and 25, the gas which has not been dissolved flows out as bubbles along with the liquid from the exit port provided in such a position, reducing the utilization of the gas and forming a mixed flow of the gas and liquid including large bubbles. If the exit port 16 is positioned directly under the nozzle 12 as in the present embodiment, a flow caused by a jet 15 is not directed to the exit port 16 and bubbles resulting from insufficient dissolution are collected on the rear side of the diaphragm 25 during the travel of the mixed flow of the gas and liquid toward the exit port 16 and do not easily flow out from the exit port 16. The collected bubbles are appropriately released upward through the through hole 72 to prevent the gas from being wastefully emitted.

Referring to conditions to collect the bubbles on the rear side of the diaphragm 25, when the flow rate in the channel below the mixing container 14 is 0.1 m/s or less, a relationship $L/H>4$ is preferably satisfied where the height H and length L of the channel below the mixing container 14 in FIG. 25. The exit port 16 may be positioned on wall surfaces other than the wall surface facing the injecting direction of the liquid and wall surfaces in the vicinity thereof. Further, if the diaphragm 25 is slightly inclined to raise its end opposite to the exit port 16, the bubbles naturally flows upward and moves toward the upper part of the mixing container 14.

In the apparatus for dissolving and mixing a gas and a liquid according to the present embodiment, a liquid which dissolved a gas therein is pumped by the pump 30 to flow in the nozzle 12 through the pipe line 34. The liquid is accelerated by the nozzle 12 and to become a jet 15 which is ejected into the mixing container . The mixing container is filled in advance with the gas to be dissolved in the liquid whose volume is compressed by the liquid that flows in to establish a pressurized state in the mixing container 14 gradually. A reaction or dissolution between the gas and liquid takes place in the mixing container 14 in such a pressurized state.

In order to cause the reaction or dissolution between the gas and liquid efficiently, the flow rate of the jet 15 of the accelerated liquid must be at least on the order of 5.0 m/s and is preferably about 10 m/s when energy efficiency is considered. After being subjected to the reaction with the gas, the liquid flows out from the mixing container 14 through the pipe line 18 connected to the exit port 16. Since the exit port 16 is provided at a lower part of the mixing container 14, the gas contained in the container does not flow out but the liquid, and the liquid which has passed through the pipe line 18 is accelerated by the decompression nozzle 80 to be ejected into the liquid bath 88.

In the present embodiment, a more efficient reaction or dissolution between a gas and a liquid will be achieved with a liquid level 24 located close to the position of the opening of the nozzle 12 during a normal operation. The liquid level can be set in such a position when the above-described Equation 3 is satisfied between the volume of each part of the mixing container 14 and the pressure in the container.

When the gas in the mixing container 14 decreases and fall short as a result of the dissolution or reaction between the gas and liquid, the solenoid valve 82 is opened to supply the gas from the pipe line 36 to the pipe line 34 upstream of the nozzle 12. The supply pressure of the gas at this time is slightly higher than the supply pressure of the liquid at the connection between the pipe line 34 and 36 (110% or less of the supply pressure of the liquid in the pipe line 34) and is preferably about 105% of the supply pressure of the liquid. The pressure of the gas is appropriately set so as to satisfy the above-mentioned condition by adjusting the pressure in the tank 74 through adjustment of the opening of the valve 84 as a restrictor. The gas is supplied without stopping the pump 30 for pumping the liquid. The timing at which the gas is supplied has a predetermined period which is controlled, for example, by a timer based on the rate of consumption of the gas calculated from the liquid flow rate and the static pressure inside the mixing container 14. Alternatively, the opening and closing of the solenoid valve 82 may be controlled such that the amount of the gas in the mixing container 14 in terms of a detected liquid level 24 stays in a predetermined positional range.

While the gas is being supplied, the pressure in the pipe line 34 is increased by the gas that flows therethrough, which is accompanied by an increase in the load to the pump 30. This can be managed by employing an appropriate pump 30, and no back-flow of the gas occurs because of the presence of the check valve 35. Further, in order to suppress a water hammer phenomenon caused by fluctuations in the pressure while the gas is being supplied, a relief valve 86 is connected to the pipe line 34 as needed.

The following relationship is satisfied where P1 and Q1 respectively represent the pressure in the mixing container 14 and the flow rate of the liquid when no gas is supplied thereto and where P2 and Q2 respectively represent the pressure in the mixing container 14 and the flow rate of the liquid while the gas is being supplied.

$$Q1/Q2=(P1/P2)1/2 \quad (4)$$

It is apparent from the above that the smaller the difference between the pressures P1 and P2 in the mixing container 14, the smaller the fluctuations of the flow rates Q1 and Q2.

The apparatus for dissolving and mixing a gas and a liquid according to the present embodiment does not involve suction and pumping of the gas during normal pumping of the liquid. As a result, the liquid can be pumped with a relatively low level of energy, and the gas and liquid are mixed at high efficiency. Further, when the gas is reduced, the gas is replenished by supplying it to the pipe line 34 for pumping the liquid at a pressure slightly higher than the supply pressure of the liquid. This allows a continuous operation without stopping the pumping of the liquid and makes it possible to supply a liquid including the gas dissolved therein from the decompression nozzle 80 continuously and substantially constantly. In addition, according to the present embodiment, the gas is unlikely to flow out from the exit port 16 because the liquid is returned from the region under the diaphragm 25 to the region above the same via the through hole 72, which prevents the gas from being wasted to achieve efficient utilization of the same.

Figure 27:
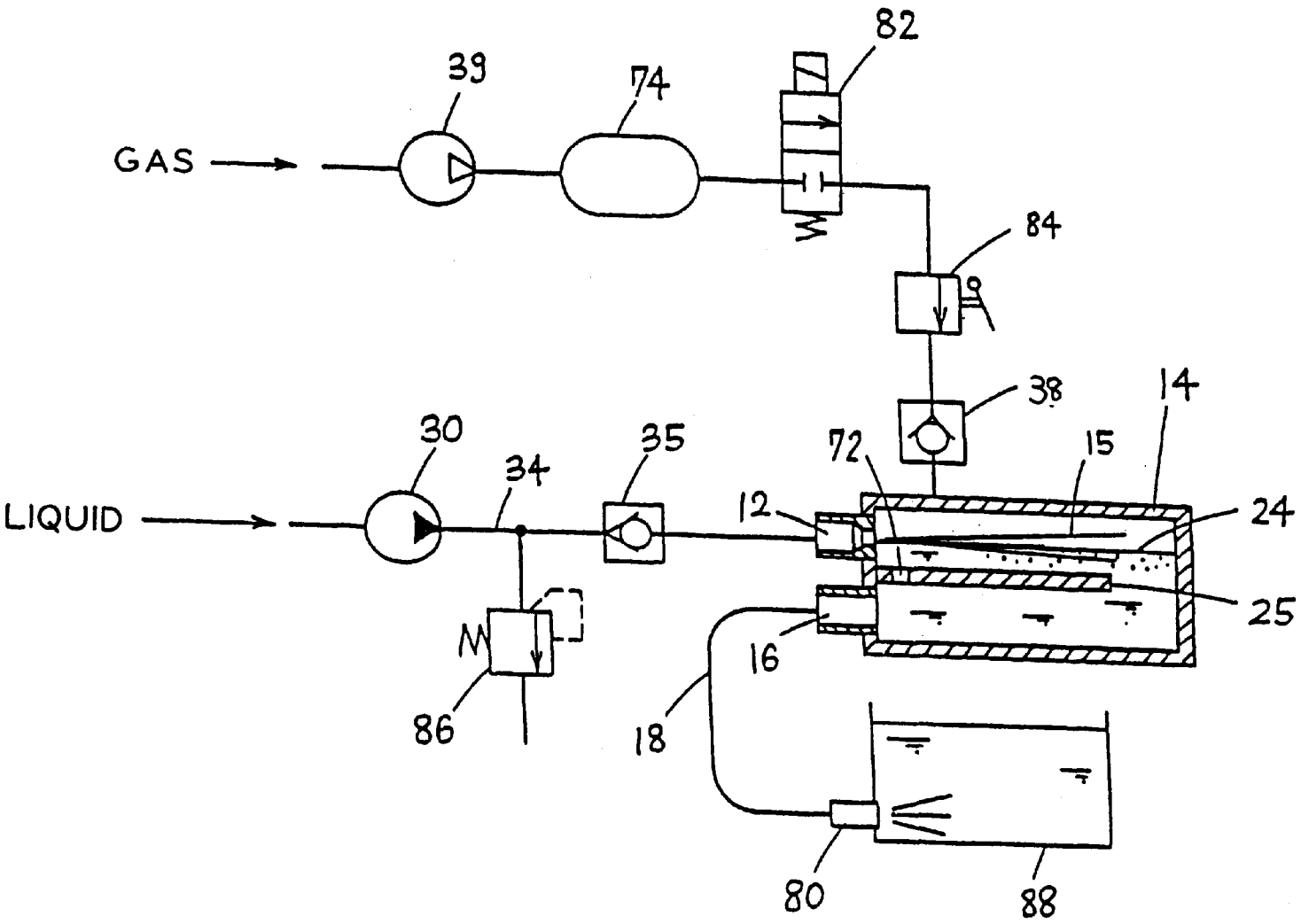
FIG. 27 is a schematic view of a apparatus for dissolving and mixing a gas and a liquid according to an eighteenth embodiment.

FIG. 27 shows an eighteenth embodiment of the present invention. Parts identical to those in the above-described embodiments are indicated by like reference numbers and will now be described. The apparatus for dissolving and mixing a gas and a liquid according to the present embodiment is obtained by connecting a pipe pile 36 for supplying a gas such that it opens into an upper part of a mixing container 14 of an apparatus for dissolving and mixing a gas and a liquid according to the seventeenth embodiment.

In the present embodiment, the gas is directly supplied to a space where the gas is stored at the upper part of the mixing container 14 at a pressure which is sufficient if it is only slightly higher than the pressure of the gas inside the mixing container 14. The supply pressure of the gas may be lower than that in the seventeenth embodiment, although the difference is very small. The pressure of the gas is again adjusted through adjustment of a valve 84 to set it at a value slightly higher than the pressure of the gas in the mixing container 14 (110% or less of the gas pressure in the mixing container). Again, the pressure is preferably about 105% of the pressure of the gas in the mixing container.

According to the present embodiment, since the gas is supplied through a direct connection to the mixing container 14, there is less fluctuation in the pressure that acts on a pipe line 34 and a pump 30 for pumping the liquid while the gas is being supplied. This makes it possible to operate the pump 30 continuously at a substantially constant load.

According to the present invention, a gas is supplied using a gas cylinder as a source in addition to the configuration using the compressor 39 and the tank 74. Further, the decompression nozzle 80 as a restrictor may be a different kind of fixed restrictor, a variable restrictor or an appropriate valve. Furthermore, although the decompression nozzle 80 has been described as being directly connected to the liquid bath 88, it may be provided halfway in the pipe line 18.

The apparatus for dissolving and mixing a gas and a liquid according to the present invention is not limited to the above-described embodiments and may be implemented as appropriate combinations of the above-described embodiments. For example, highly efficient pressurized mixing and dissolution may be achieved by providing a parallel configuration of a plurality of apparatuses in which a plurality of mixing containers are connected in series.

A description will now be made on the implementation of an apparatus for dissolving and mixing a gas and a liquid according to the present invention.

An experiment made to compare an apparatus according to the first embodiment with a conventional apparatus indicated that in order to obtain a pressurized state of 0.3 MPa, the apparatus according to the embodiment consumes energy which is only one-third of that consumed by the conventional apparatus and is therefore quite efficient. The embodiment also exhibited an utilization rate of a gas as high as 98%.

An apparatus according to the seventeenth embodiment was operated with the liquid supply pressure, the gas supply pressure and the pressure in the mixing container 14 with no supply of the gas set at 0.32 MPa, 0.34 MPa and 0.30 MPa, respectively. Then, fluctuation in the liquid flow rate that depended on whether the gas was supplied or not was in the range from about 3% to about 4%, which proved that a substantially continuous operation was achieved.

Figure 28:
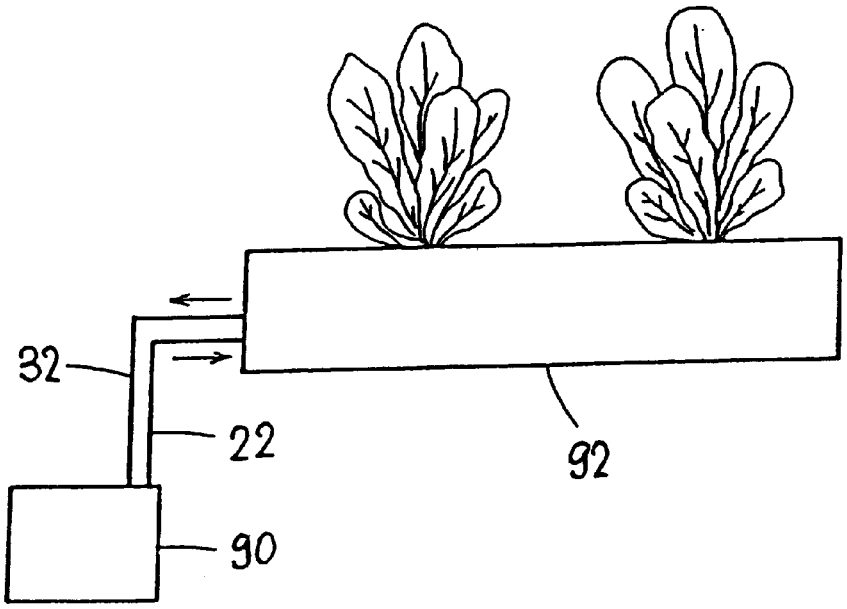
FIG. 28 is a schematic view of an embodiment in which an apparatus for dissolving and mixing a gas and a liquid according the present invention is used for hydroponic culture.

FIG. 28 shows a case wherein an apparatus 90 according to the first embodiment of the invention is used for hydroponics. The apparatus 90 for dissolving and mixing a gas and a liquid supplied oxygen to a cultivation liquid supplied to a bed 92 for hydroponics, resulting in a dissolved oxygen concentration which is 130% of a saturation-dependent oxygen concentration. This promoted the growth of the stems, leaves, and fruits of the cultivated plants.

Figure 29:
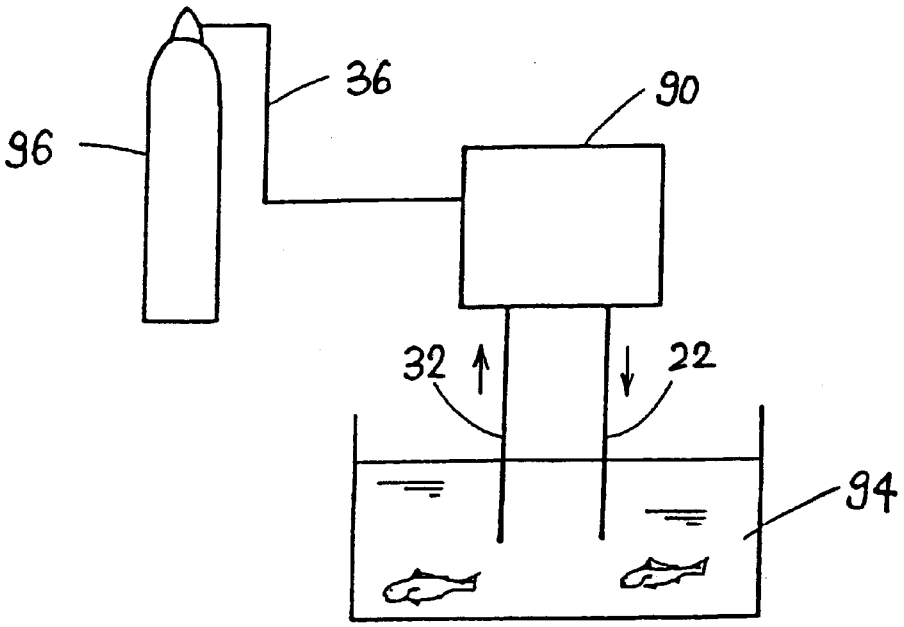
FIG. 29 is a schematic view of an embodiment in which an apparatus for dissolving and mixing a gas and a liquid according the present invention is used in an oxygen supplying apparatus for a fish preserve.

FIG. 29 shows a case wherein an apparatus 90 according to the first embodiment of the invention is used for an apparatus for supplying oxygen to a fish preserve 94. Oxygen is supplied from an oxygen gas cylindar 96 to the fish preserve 94. In this case, the oxygen utilization rate was improved to 98% from 5% which is achievable in the prior art wherein the oxygen from the oxygen gas cylindar is simply supplied to the fish preserve 94 in the form of bubbles. Such a significant improvement of the oxygen utilization rate allows a quite significant cost reduction even if costs including electrical energy required for the present embodiment are taken into consideration.

The method and apparatus for dissolving and mixing a gas and a liquid according to the present invention make it possible to achieve pressurized dissolution and mixing of a gas and a liquid efficiently with small energy and without wasting the gas, and the apparatus can be made compact.

The apparatus can be continuously and substantially constantly operated and the gas can be supplied with small energy in some configurations.

What is claimed is:

1. A method of dissolving and mixing a gas and a liquid comprising the steps of:

providing an injection portion for injecting a liquid in a horizontal direction at an upper part of a mixing container filled with a gas;

providing a restrictor, which is a restricted channel, for maintaining a pressurized state in said mixing container downstream of said mixing container;

injecting a liquid into the mixing container from the injection portion to cause a reaction or dissolution between the gas in said mixing container and the injected liquid in the pressurized state and to cause a liquid including the gas dissolved therein to flow from a lower part of said mixing container;

stopping the supply of the liquid into said mixing container when the gas in said mixing container is reduced as a result of the dissolution of the gas into the liquid therein;

supplying the gas into said mixing container; and alternately performing the injection of the liquid and the supply of the gas into said mixing container.

2. The method of dissolving and mixing a gas and a liquid according to claim 1, wherein the rate of the liquid injected from said injection portion is in the range from 5 m/s to 15 m/s.

3. The method of dissolving and mixing a gas and a liquid according to claim 1, wherein the level of a liquid in said mixing container is adjusted substantially to the height of an exit port of said injection portion.

4. A method of dissolving and mixing a gas and a liquid comprising the steps of:

providing an injection portion for injecting a liquid in a horizontal direction at an upper part of a mixing container filled with a gas;

providing a restrictor, which is a restricted channel, for maintaining a pressurized state in said mixing container downstream of said mixing container;

injecting a liquid into the mixing container from the injection portion to cause a reaction or dissolution between the gas in said mixing container and the injected liquid in the pressurized state and to cause a liquid including the gas dissolved therein to flow from a lower part of said mixing container; and injecting the gas into a liquid supplying pipe line upstream of said injection portion at a pressure slightly higher than the supply pressure of the liquid when the gas in said mixing container is reduced as a result of the dissolution of the gas into the liquid therein.

5. A method of dissolving and mixing a gas and a liquid comprising the steps of:

providing an injection portion for injecting a liquid in a horizontal direction at an upper part of a mixing container filled with a gas;

providing a restrictor, which is a restricted channel, for maintaining a pressurized state in said mixing container downstream of said mixing container;

injecting a liquid into the mixing container from the injection portion to cause a reaction or dissolution between the gas in said mixing container and the injected liquid in the pressurized state and to cause a liquid including the gas dissolved therein to flow from a lower part of said mixing container; and injecting the gas into said mixing container at a pressure slightly higher than the pressure in said mixing container when the gas in said mixing container is reduced as a result of the dissolution of the gas into the liquid therein.

6. An apparatus for dissolving and mixing a was and a liquid comprising:

a mixing container filled with a gas;

an injection portion provided at an upper part of the mixing container for injecting a liquid into said mixing container in a hermetic state in a horizontal direction;

an exit port for said liquid provided at a lower part of said mixing container; and a restrictor, which is a restricted channel, provided downstream of the exit port for maintaining a pressurized state in said mixing container, wherein a liquid is injected into said mixing container to cause a reaction or dissolution between the gas in said mixing container and the injected liquid and to supply a liquid including the gas dissolved therein through said exit port and restrictor, wherein said injection portion comprises a suction device including:

a restriction which is a restricted part of a fluid channel;

a gas intake port connected to a channel slightly downstream of the restriction for introducing a gas from the outside; and an expanded portion which is a gradually expanded pipe line provided downstream of said restriction, and wherein a pipe line downstream of said exit port is branched, a restrictor, which is a restricted channel, is provided on one of the pipe lines for maintaining a pressurized state in said mixing container; and an on-off valve is provided on the other pipe line.

7. The apparatus for dissolving and mixing a gas and a liquid according to claim 6 and including a gas injection means comprising a transfer valve, and a gas supply source provided upstream of a gas tank.

8. The apparatus for dissolving and mixing a gas and a liquid according to claim 6, wherein a plurality of mixing containers having said injection portion are disposed; each of said injection portions is connected to a liquid supply source through a pipe line; and a pipe line and a restrictor are provided at an exit port of each of said mixing container.

9. An apparatus for dissolving and mixing a gas and a liquid comprising:

a mixing container filled with a gas;

an injection portion provided at an upper part of the mixing container for injecting a liquid into said mixing container in a hermetic state in a horizontal direction;

an exit port for said liquid provided at a lower part of said mixing container; and a restrictor, which is a restricted channel, provided downstream of the exit port for maintaining a pressurized state in said mixing container, wherein a liquid is injected into said mixing container to cause a reaction or dissolution between the gas in said mixing container and the injected liquid and to supply a liquid including the gas dissolved therein through said exit port and restrictor, and further comprising a diaphragm provided below said injection portion in said liquid injecting direction, wherein said exit port is mounted below said diaphragm and substantially directly under said injection portion and a through hole formed on said diaphragm toward said injection portion.

10. The apparatus for dissolving and mixing a gas and a liquid according to claim 9, wherein said through hole is formed such that it is relatively larger in the lower part thereof.

* * * * *

UNITED STATES PATENT AND TRADEMARK OFFICE

CERTIFICATE OF CORRECTION

PATENT NO : 6,142,456

DATED : January 5, 2001

INVENTOR(S) : Machiya et, al.

It is certified that error appears in the above-identified patent and that said Letters Patent are hereby corrected as shown below:

Claim 6,Column 18,Line 37 delete "was" and substitute therefor --gas--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*